US011501691B2

(12) United States Patent
Sung et al.

(10) Patent No.: US 11,501,691 B2
(45) Date of Patent: Nov. 15, 2022

(54) DISPLAY DEVICE

(71) Applicant: Samsung Display Co., Ltd., Yongin-Si (KR)

(72) Inventors: Si Duk Sung, Yongin-si (KR); Sang Hyun Lee, Yongin-si (KR); Myeong Su Kim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/917,740

(22) Filed: Jun. 30, 2020

(65) Prior Publication Data

US 2021/0142714 A1 May 13, 2021

(30) Foreign Application Priority Data

Nov. 7, 2019 (KR) ..... 10-2019-0141981

(51) Int. Cl.
*G09G 3/20* (2006.01)
*G09G 3/3266* (2016.01)
(Continued)

(52) U.S. Cl.
CPC ..... *G09G 3/2092* (2013.01); *G09G 3/296* (2013.01); *G09G 3/3266* (2013.01);
(Continued)

(58) Field of Classification Search
CPC ..... G09G 2310/0289; G09G 2310/08; G09G 2310/066; G09G 2310/061; G09G 3/3677; G09G 3/2011; G09G 3/2092; G09G 2320/0223; G09G 2300/0871; G09G 2310/0286; G09G 2310/0267; G09G 2310/0202; G09G 2310/06; G09G 3/3648; G09G 3/3266; G09G 3/2014;
(Continued)

(56) References Cited

U.S. PATENT DOCUMENTS 7,567,324 B2 7/2009 Lee et al.
8,405,595 B2 * 3/2013 Cho ..... G09G 3/3266 345/94
(Continued)

FOREIGN PATENT DOCUMENTS

KR 10-1148563 B1 5/2012
KR 10-2016-0047271 A 5/2016
(Continued)

*Primary Examiner* — Dismery Mercedes
(74) *Attorney, Agent, or Firm* — Innovation Counsel LLP

(57) ABSTRACT

A display device may include a timing controller, a level shifter, a gate driver, and a display panel. The timing controller may generate a first on-clock signal, a first off-clock signal, and a first output control signal. The level shifter may generate a first-type gate clock signal. A rising edge of the first-type gate clock signal and a falling edge of the first-type gate clock signal may be respectively synchronized with a rising edge of the first on-clock signal and a falling edge of the first off-clock signal. The gate driver may output first-type gate signals based on the first-type gate clock signal. The display panel may include pixels. The pixels may emit lights in response to the first-type gate signals. The level shifter may partially block a pulse of the first-type gate clock signal based on the first output control signal to generate sub-pulses.

19 Claims, 19 Drawing Sheets

(51) Int. Cl.
*G09G 3/36* (2006.01)
*G09G 3/296* (2013.01)

(52) U.S. Cl.
CPC ..... *G09G 3/3677* (2013.01); *G09G 3/3696* (2013.01); *G09G 2300/0871* (2013.01); *G09G 2310/0267* (2013.01); *G09G 2310/0289* (2013.01); *G09G 2310/066* (2013.01); *G09G 2310/08* (2013.01)

(58) Field of Classification Search
CPC .. G09G 3/3696; G09G 3/3674; G09G 3/3688; G09G 5/18; G06F 3/04166; G06F 3/04184; G06F 3/0416; G06F 3/0412
See application file for complete search history.

(56) References Cited

U.S. PATENT DOCUMENTS 9,224,347 B2 * 12/2015 Han ..... G09G 3/3611
9,564,096 B2 * 2/2017 Hwang ..... G09G 3/3677
9,704,431 B2 * 7/2017 Cho ..... G09G 3/3225
10,810,946 B2 * 10/2020 Han ..... G09G 3/3266
10,916,189 B2 * 2/2021 Cho ..... G09G 3/3225
11,263,977 B2 * 3/2022 Kim ..... G09G 3/3266
2007/0296682 A1 * 12/2007 Hwang ..... G11C 19/00 345/100
2008/0030490 A1 * 2/2008 Son ..... G09G 3/3648 345/205
2012/0133627 A1 * 5/2012 Moon ..... G09G 3/3648 345/94
2013/0314392 A1 * 11/2013 Kim ..... G11C 19/28 345/212
2014/0104248 A1 * 4/2014 Won ..... G09G 3/3696 345/204
2017/0186373 A1 * 6/2017 Nishikawa ..... G11C 19/28
2019/0081471 A1 * 3/2019 Park ..... H02H 3/08
2019/0081474 A1 * 3/2019 Colbaugh ..... H01H 71/082
2019/0103069 A1 * 4/2019 Choi ..... G09G 3/3677
2019/0197964 A1 * 6/2019 Cho ..... G09G 3/3685
2020/0020280 A1 * 1/2020 Han ..... G09G 3/3266
2020/0098312 A1 * 3/2020 Cho ..... G09G 3/3275

FOREIGN PATENT DOCUMENTS

KR 10-2016-0089648 A 7/2016
KR 10-2016-0094469 A 8/2016
KR 10-2017-0015691 A 2/2017

* cited by examiner

DISPLAY DEVICE

CROSS-REFERENCE TO RELATED APPLICATION

The present application claims priority under 35 U.S.C. § 119(a) to Korean patent application No. 10-2019-0141981 filed on Nov. 7, 2019 in the Korean Intellectual Property Office; the Korean patent application is incorporated by reference.

BACKGROUND

1. Technical Field

The technical field relates to a display device.

2. Related Art

A display device may include a display panel including gate lines, data lines, and pixels, a gate driver for providing gate signals through the gate lines, a data driver for providing data signals through the data lines, a timing controller for controlling a driving timing of each of the gate driver and the data driver, and a level shifter for generating a clock signal, etc. to be provided to the gate driver, based on a signal provided from the timing controller.

The gate driver may require many clock signals so as to sequentially supply gate signals (e.g., scan signals) to the gate lines. Accordingly, a significant number of signal lines for transmitting clock signals (or signals required to generate the clock signals) between the timing controller and the gate driver (or level shifter) may be required.

In addition, the timing controller may provide the level shifter with a control signal for compensating for a kickback phenomenon. Accordingly, a separate signal line for providing the control signal may be required.

SUMMARY

Embodiments may be related to a display device with a minimum number of signal lines coupled between a timing controller and a level shifter, a minimum number of output pins of the timing controller, and a minimum number of input pins of the level shifter.

Embodiments may be related to a display device capable of generating a clock signal for compensating for a kickback phenomenon occurring in a pixel.

In accordance with an embodiment, a display device may include the following elements: a timing controller configured to generate a first on-clock signal, a first off-clock signal, and a first output control signal; a level shifter configured to generate first gate clock signals having a rising edge and a falling edge, which respectively correspond to a rising edge of the first on-clock signal and a falling edge of the first off-clock signal; a gate driver configured to output first gate signals, based on the first gate clock signals; and a display panel including pixels which emit lights in response to the first gate signals, wherein the level shifter divides one pulse included in each of the first gate clock signals into a plurality of pulses by partially blocking the one pulse included in each of the first gate clock signals, based on the first output control signal.

The level shifter may divide the one pulse into a first pulse including a first rising edge and a first falling edge and a second pulse including a second rising edge and a second falling edge.

The first output control signal may not overlap with each of the first pulse and the second pulse.

The level shifter may include: a first gate clock output unit configured to generate the first rising edge, corresponding to the rising edge of the first on-clock signal, and configured to generate the second falling edge, corresponding to the falling edge of the first off-clock signal; and a first gate clock output controlling unit configured to generate the first falling edge, corresponding to a rising edge of the first output control signal, and configured to generate the second rising edge, corresponding to a falling edge of the first output control signal.

The first gate clock output unit may gradually decrease the second pulse from a first level to a second level lower than the first level, during a period from a time at which a rising edge of the first off-clock signal is generated to a time at which the falling edge of the first off-clock signal is generated, and decrease the second pulse from the second level to a third level lower than the second level, at the time at which the falling edge of the first off-clock signal is generated.

The first on-clock signal may include a plurality of pulses formed to have a predetermined period. The first off-clock signal may have the same period as the first on-clock signal, and include a plurality of pulses formed at the same time as the pulses of the first on-clock signal.

The first on-clock signal may include may include a plurality of pulses formed to have a predetermined period. The first off-clock signal may have the same period as the first on-clock signal, and include a plurality of pulses formed at a time which is different from a time at which the pulses of the first on-clock signal are formed.

The display device may further include a sensing unit configured to sense the pixels in response to second gate signals. The timing controller may further generate a second on-clock signal, a second off-clock signal, and a second output control signal. The level shifter may generate second gate clock signals having a rising edge and a falling edge, which respectively correspond to a rising edge of the second on-clock signal and a falling edge of the second off-clock signal, and divide one pulse included in each of the second gate clock signals into a plurality of pulses by partially blocking the one pulse included in each of the second gate clock signals, based on the second output control signal. The gate driver may output the second gate signals, based on the second gate clock signals.

The first output control signal may overlap with the first pulse in a partial period, and does not overlap with the second pulse.

The level shifter may include a signal converting unit. The signal converting unit may generate a first sub-output control signal by delaying the first output control signal by a predetermined time, generate a second sub-output control signal by inverting the first sub-output control signal, generate a third sub-output control signal by performing an AND operation on the first output control signal and the second sub-output control signal, and generate a fourth sub-output control signal by performing an AND operation on the first output control signal and the first sub-output control signal.

The level shifter may further include: a first gate clock output unit configured to generate the first rising edge, corresponding to the rising edge of the first on-clock signal, and configured to generate the second falling edge, corresponding to the falling edge of the first off-clock signal; and a first gate clock output controlling unit configured to generate the first falling edge, corresponding to a rising edge of the fourth sub-output control signal, and configured to generate the second rising edge, corresponding to a falling edge of the fourth sub-output control signal.

The first gate clock output unit may gradually decrease the second pulse from a first level to a second level lower than the first level, during a period from a time at which a rising edge of the first off-clock signal is generated to a time at which the falling edge of the first off-clock signal is generated, and decrease the second pulse from the second level to a third level lower than the second level, at the time at which the falling edge of the first off-clock signal is generated.

The first gate clock output unit may gradually decrease the first pulse from the first level to the second level, during a period from a time at which a rising edge of the third sub-output control signal is generated to a time at which a falling edge of the third sub-output control signal is generated, and decrease the first pulse from the second level to the third level, at the time at which the falling edge of the third sub-output control signal is generated.

In accordance with an embodiment, a display device may include the following elements: a timing controller configured to generate a first on-clock signal and a first off-clock signal; a level shifter configured to generate first gate clock signals having a rising edge and a falling edge, which respectively correspond to a rising edge of the first on-clock signal and a falling edge of the first off-clock signal; a gate driver configured to output first gate signals, based on the first gate clock signals; and a display panel including pixels which emit lights in response to the first gate signals, wherein the level shifter divides one pulse included in each of the first gate clock signals into a plurality of pulses by partially blocking the one pulse included in each of the first gate clock signals, based on predetermined edge time information.

The level shifter may divide the one pulse into a first pulse including a first rising edge and a first falling edge and a second pulse including a second rising edge and a second falling edge.

The predetermined edge time information may include first information on a time at which the first falling edge of the first pulse is generated and second information on a time at which the second rising edge of the second pulse is generated. The level shifter may include: a memory configured to store the first information and the second information; a first gate clock output unit configured to generate the first rising edge, corresponding to the rising edge of the first on-clock signal, and configured to generate the second falling edge, corresponding to the falling edge of the first off-clock signal; and a first gate clock output controlling unit configured to generate the first falling edge, based on the first information, and configured to generate the second rising edge, based on the second information.

The first gate clock output unit may gradually decrease the second pulse from a first level to a second level lower than the first level, during a period from a time at which a rising edge of the first off-clock signal is generated to a time at which the falling edge of the first off-clock signal is generated, and decrease the second pulse from the second level to a third level lower than the second level, at the time at which the falling edge of the first off-clock signal is generated.

The timing controller may further generate a kickback compensation signal. The first gate clock output unit may gradually decrease the first pulse from the first level to the second level, during a period from a time at which a rising edge of the kickback compensation signal is generated to a time at which a falling edge of the kickback compensation signal is generated, and decrease the first pulse from the second level to the third level, at the time at which the falling edge of the kickback compensation signal is generated.

An embodiment may be related to a display device. The display device may include a timing controller, a level shifter, a gate driver, and a display panel. The timing controller may generate a first on-clock signal, a first off-clock signal, and a first output control signal. The level shifter may be electrically connected to the timing controller and may generate a first first-type gate clock signal. A rising edge of the first first-type gate clock signal and a falling edge of the first first-type gate clock signal may be respectively synchronized with a rising edge of the first on-clock signal and a falling edge of the first off-clock signal. The gate driver may be electrically connected to the level shifter and may output first-type gate signals based on the first first-type gate clock signal. The display panel may be electrically connected to the gate driver and may include pixels. The pixels may emit lights in response to the first-type gate signals. The level shifter may partially block a pulse of the first first-type gate clock signal based on the first output control signal to generate first-type sub-pulses.

The first-type sub-pulses may include a first first-type sub-pulse and a second first-type sub-pulse. The first first-type sub-pulse may include a first rising edge and a first falling edge. The second first-type sub-pulse may include a second rising edge and a second falling edge.

A pulse of the first output control signal may occur after the first rising edge and before the second falling edge.

The level shifter may include a first gate clock output unit and a first gate clock output controlling unit. The first gate clock output unit may generate the first rising edge and the second falling edge. The first rising edge may be synchronized with a rising edge of a pulse of the first on-clock signal. The second falling edge may be synchronized with a falling edge of a pulse of the first off-clock signal. The first gate clock output controlling unit may generate the first falling edge and the second rising edge. The first falling edge may be synchronized with a rising edge of the pulse of the first output control signal. The second rising edge may be synchronized with a falling edge of the pulse of the first output control signal.

The first gate clock output unit may gradually decrease the second first-type sub-pulse from a first level to a second level lower than the first level during a period from a time of a rising edge of the pulse of the first off-clock signal to a time of the falling edge of the pulse of the first off-clock signal may be generated. The first gate clock output unit may decrease the second first-type sub-pulse from the second level to a third level lower than the second level at the time of the falling edge of the pulse of the first off-clock signal.

Pulses of the first on-clock signal may be provided according to a predetermined period. Pulses of the first off-clock signal may be provided according to the predetermined period and may be synchronized with the pulses of the first on-clock signal.

Pulses of the first on-clock signal may be provided according to a predetermined period. Pulses of the first off-clock signal may be provided according to the predetermined period. Each pulse of the pulses formed of the first off-clock signal may be provided between two successive pulses of the pulses of the first on-clock signal.

The display device may include a sensing unit configured to sense the pixels in response to second-type gate signals. The timing controller may generate a second on-clock signal, a second off-clock signal, and a second output control signal. The level shifter may generate a first second-type gate clock signal. A rising edge of the first second-type gate clock signal and a falling edge of the first second-type gate clock signal are respectively synchronized with a rising edge of the second on-clock signal and a falling edge of the second off-clock signal. The level shifter may partially block a pulse of the first second-type gate clock signal based on the second output control signal to generate second-type sub-pulses. The gate driver may output the second-type gate signals based on the second-type gate clock signals.

A pulse of the first output control signal may overlap a portion of the first first-type sub-pulse and may not overlap the second first-type sub-pulse.

The level shifter may include a signal converting unit. The signal converting unit may generate a first output control sub-signal by delaying a first copy of the first output control signal by a predetermined time. The signal converting unit may generate a second output control sub-signal by inverting a second copy of the first sub-output control signal. The signal converting unit may generate a third output control sub-signal by performing an AND operation on the first output control signal and the second output control sub-signal. The signal converting unit may generate a fourth output control sub-signal by performing an AND operation on the first output control signal and the first output control sub-signal.

The level shifter may include a first gate clock output unit and a first gate clock output controlling unit. The first gate clock output unit may generate the first rising edge and the second falling edge. The first rising edge may be synchronized with a rising edge a pulse of the first on-clock signal. The second falling edge may be synchronized with a falling edge of a first pule of the first off-clock signal. The first gate clock output controlling unit may generate the first falling edge and the second rising edge. The first falling edge may be synchronized with a rising edge of a pulse of the fourth output control sub-signal. The second rising edge may be synchronized with a falling edge the pulse of the fourth output control sub-signal.

The first gate clock output may gradually decrease the second first-type sub-pulse from a first level to a second level lower than the first level during a period from a time of a rising edge of a pulse of the first off-clock signal to a time of a falling edge of the pulse of the first off-clock signal. The first gate clock output may gradually decrease the second first-type sub-pulse from the second level to a third level lower than the second level at the time of the falling edge of the pulse of the first off-clock signal.

The first gate clock output unit may gradually decrease the first first-type sub-pulse from the first level to the second level during a period from a time of a rising edge of a pulse of the third sub-output control signal to a time of a falling edge of the pulse of the third sub-output control signal. The first gate clock output unit may decrease the first first-type sub-pulse from the second level to the third level at the time of the falling edge of the pulse of the third sub-output control signal.

An embodiment may be related to a display device. The display device may include a timing controller, a level shifter, a gate driver, and a display panel. The timing controller may generate a first on-clock signal and a first off-clock signal. The level shifter may be electrically connected to the timing controller and may generate a first first-type gate clock signal. A rising edge of the first first-type gate clock signal and a falling edge of the first first-type gate clock signal may be respectively synchronized with a rising edge of the first on-clock signal and a falling edge of the first off-clock signal. The gate driver may be electrically connected to the level shifter and may output first-type gate signals based on the first first-type gate clock signal. The display panel may be electrically connected to the gate driver and may include pixels. The pixels may emit lights in response to the first-type gate signals. The level shifter may partially block a pulse of the first first-type gate clock signal based on predetermined edge time information to generate first-type sub-pulses.

The first-type sub-pulses may include a first first-type sub-pulse and a second first-type sub-pulse. The first first-type sub-pulse may include a first rising edge and a first falling edge. The second first-type sub-pulse may include a second rising edge and a second falling edge.

The predetermined edge time information may include first information on a time of the first falling edge and may include second information on a time of the second rising edge. The level shifter may include a memory, a first gate clock output unit, and a first gate clock output controlling unit. The memory may store the first information and the second information. The first gate clock output unit may generate the first rising edge and the second falling edge. The first rising edge may be synchronized with a rising edge of a pulse of the first on-clock signal. The second falling edge may be synchronized with a falling edge of a pulse of the first off-clock signal. The first gate clock output controlling unit may generate the first falling edge and the second rising edge based on the first information and the second information, respectively.

The first gate clock output unit may gradually decrease the second first-type sub-pulse from a first level to a second level lower than the first level during a period from a time of a rising edge of the pulse of the first off-clock signal to a time of the falling edge of the pulse of the first off-clock signal may be generated. The first gate clock output unit may decrease the second pulse from the second level to a third level lower than the second level at the time of the falling edge of the pulse of the first off-clock signal.

The timing controller may generate a kickback compensation signal. The first gate clock output unit may gradually decrease the first first-type sub-pulse from the first level to the second level during a period from a time of a rising edge of a pulse of the kickback compensation signal to a time of a falling edge of the pulse of the kickback compensation signal. The first gate clock output unit may decrease the first first-type sub-pulse from the second level to the third level at the time of the falling edge of the pulse of the kickback compensation signal.

DETAILED DESCRIPTION

Figure 1:
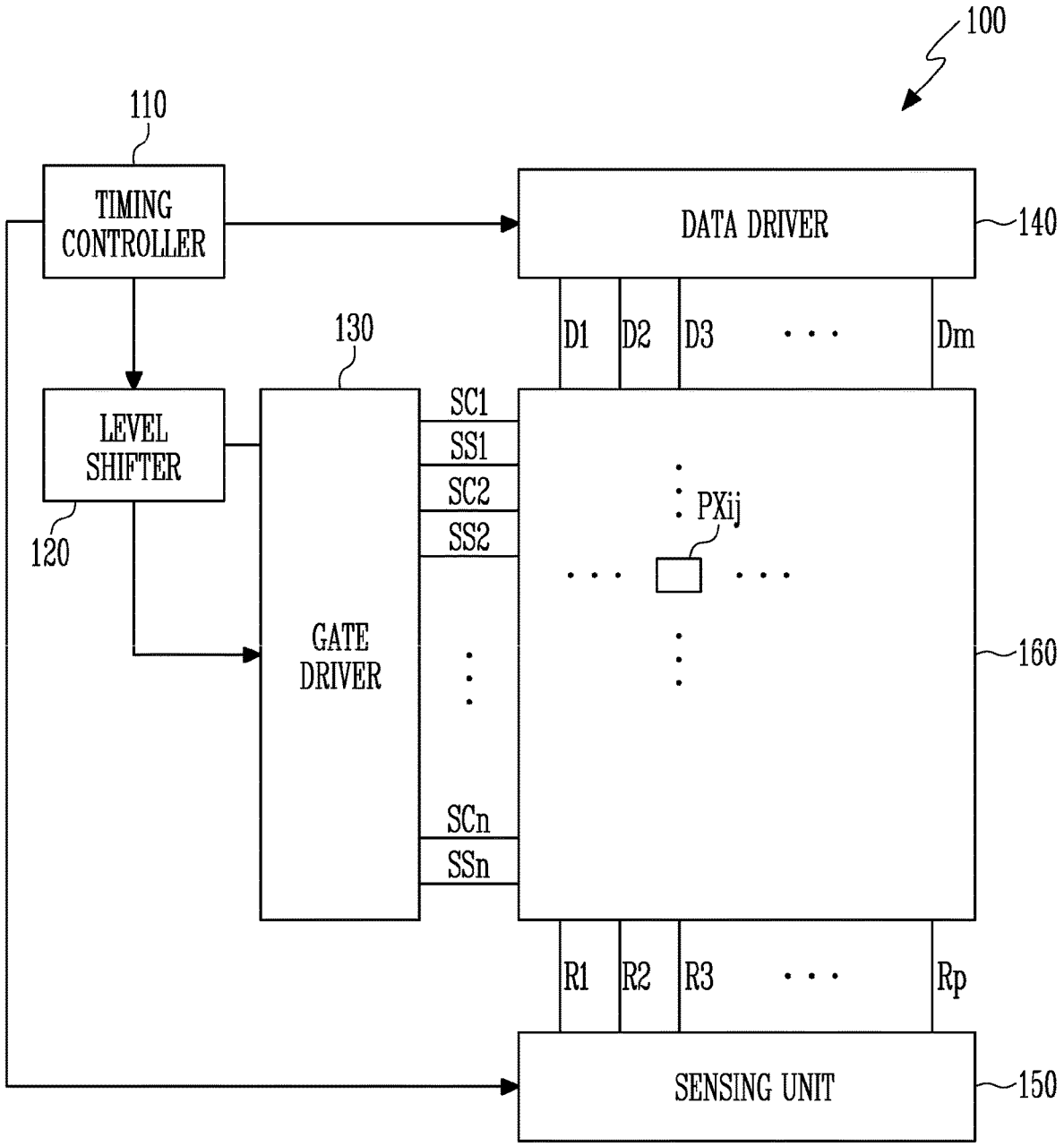
FIG. 1 is a diagram illustrating a display device in accordance with an embodiment.

Example embodiments are described with reference to the accompanying drawings. Practical embodiments may be embodied in different forms and are not limited to the described embodiments set forth herein.

In the drawing figures, dimensions may be exaggerated for clarity of illustration. Like reference numerals may refer to like elements throughout.

Although the terms "first," "second," etc. may be used to describe various elements, these elements should not be limited by these terms. These terms are used to distinguish one element from another element. Thus, a "first" element could also be termed a "second" element without departing from the teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively. Singular forms may also mean plural forms, unless the context clearly indicates otherwise.

The terms "includes" and/or "including" may specify the presence of stated features, integers, steps, operations, elements, and/or components, but may not preclude the presence and/or addition of one or more other features, integers, steps, operations, elements, components, and/or groups.

The term "couple" or "connect" may mean "electrically connect." The term "insulate" may mean "electrically insulate" or "electrically isolate." The term "drive" may mean "operate" or "control."

FIG. 1 is a diagram illustrating a display device in accordance with an embodiment.

Referring to FIG. 1, the display device 100 may include a timing controller 110, a level shifter 120, a gate driver 130, a data driver 140, a sensing unit 150, and a display panel 160.

The timing controller 110 may provide the data driver 140 with grayscale values, a control signal, and the like. The timing controller 110 may provide a clock signal, a control signal, and the like to each of the level shifter 120 and the sensing unit 150.

The level shifter 120 may generate a gate clock signal, a start pulse signal, a reset pulse signal, and the like, based on the clock signal, the control signal, and the like provided from the timing controller 110, and may provide the gate driver 130 with a gate clock signal, a start pulse signal, a reset pulse signal, and the like.

The gate driver 130 may generate scan signals and sensing signals using the gate clock signal and the like received from the level shifter 120, and may provide the scan signals and the sensing signals respectively to scan lines SC1, SC2, . . . , and SCn (n is a positive integer) and sensing lines SS1, SS2, . . . , SSn. The gate driver 130 may sequentially provide scan signals and sensing signals, which have pulses of a turn-on level, respectively to the scan lines SC1, SC2, . . . , and SCn and the sensing lines SS1, SS2, . . . , and SSn. The gate driver 130 may generate scan signals and sensing signals in a manner that sequentially transfers a pulse of a turn-on level to a next stage according to the gate clock signal. The gate driver 130 may be/include shift register.

The gate driver 130 may be implemented as an Integrated Circuit (IC), and may be implemented in a Gate-In-Panel (GIP) configuration directly formed in the display panel 160. The gate driver 130 may be integrated with the display panel 160.

The gate driver 130 may be located at only one side of the display panel as shown in FIG. 1 or may be located at both sides of the display panel 160, according to a driving method.

The data driver 140 may generate data signals using the grayscale values, the control signal, and the like provided from the timing controller 110. The data driver 140 may sample grayscale values, and may apply data signals corresponding to the grayscale values to data lines D1, D2, . . . , and Dm (m is a positive integer) in a unit of a pixel row.

The sensing unit 150 may measure characteristic information of pixels, based on a current or voltage received through receiving lines R1, R2, . . . , Rp (p is a positive integer). The characteristic information of the pixels may include mobility information and threshold voltage information of driving transistors included in the respective pixels, degradation information of light emitting devices included in the respective pixels, and the like.

The display panel 160 may include at least portions of the scan lines SC1, SC2, . . . , and SCn, the sensing lines SS1, SS2, . . . , and SSn, at least portions of the data lines D1, D2, . . . , and Dm, at least portions of the receiving lines R1, R2, . . . , Rp, and the pixels. Each pixel PXij (each of i and j is a positive integer) may be coupled to a corresponding data line, a corresponding scan line, a corresponding sensing line, and a corresponding receiving line. In a pixel PXij, a scan transistor is coupled to an ith scan line and a jth data line. The pixel PXij may emit light in response to data signals supplied through the corresponding data line and scan signals supplied through the corresponding scan line.

Figure 2:
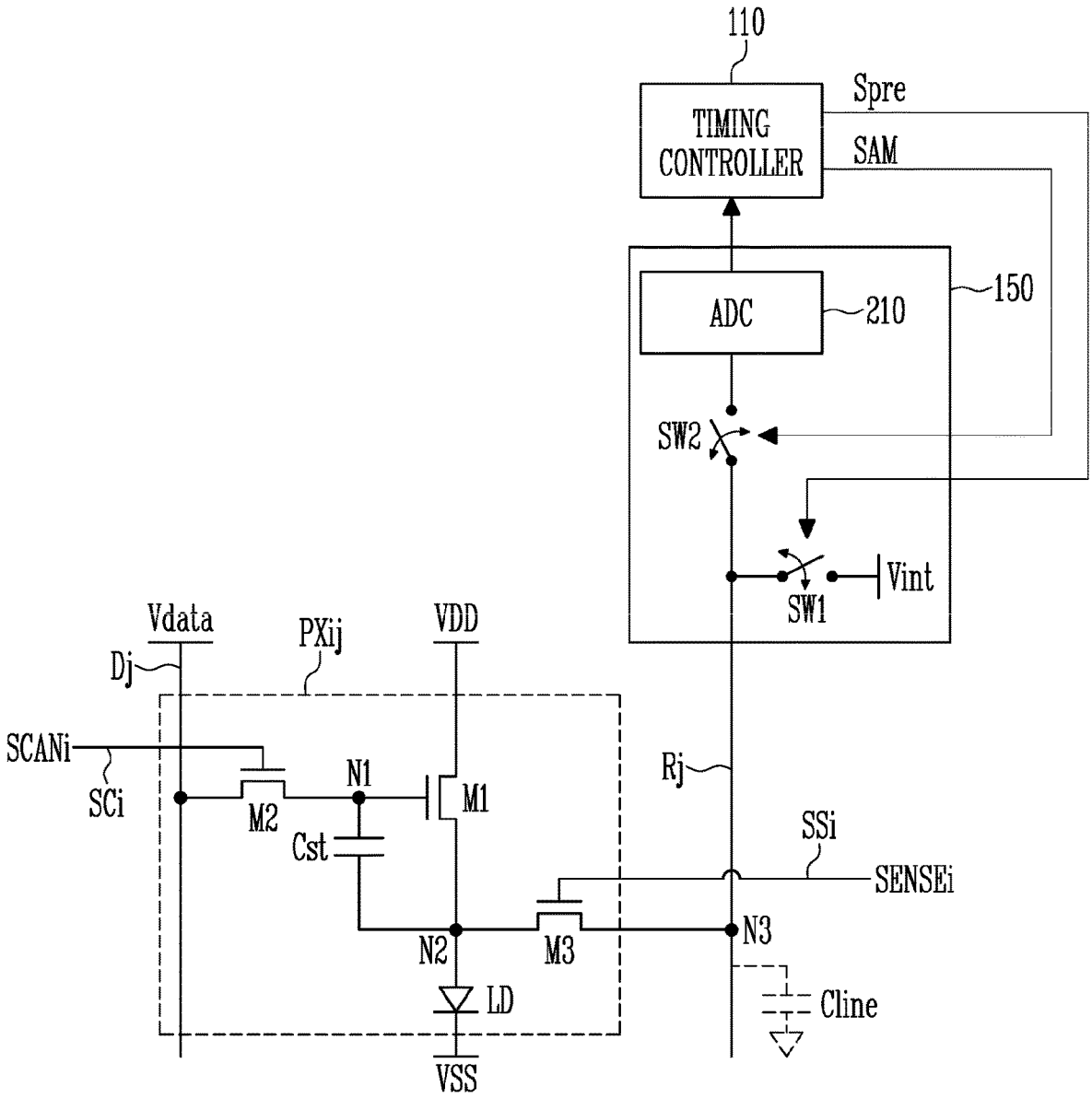
FIG. 2 is a circuit diagram illustrating a pixel and a sensing unit included in the display device shown in FIG. 1 according to an embodiment.

FIG. 2 is a circuit diagram illustrating a pixel and the sensing unit included in the display device shown in FIG. 1.

Referring to FIG. 2, the pixel PXij may include transistors M1, M2, and M3, a storage capacitor Cst, and a light emitting device LD. The transistors M1, M2, and M3 may be N-type transistors.

At least one transistor among the transistors M1, M2, and M3 may be an oxide semiconductor thin film transistor including an active layer formed of an oxide semiconductor. At least one transistor among the transistors M1, M2, and M3 may be an LTPS thin film transistor including an active layer formed of poly-silicon.

A gate electrode of a first transistor M1 may be coupled to a first node N1, one electrode (or first electrode) of the first transistor M1 may be coupled to a first power line VDD, and the other electrode (or second electrode) of the first transistor M1 may be coupled to a second node N2. The first transistor M1 may be referred to as a driving transistor. The first transistor M1 may control an amount of current flowing from the first power line VDD to a second power line VSS via the light emitting device LD, according to a voltage of the first node N1.

A gate electrode of a second transistor M2 may be coupled to a scan line SCi, one electrode of the second transistor M2 may be coupled to a data line Dj, and the other electrode of the second transistor M2 may be coupled to the first node N1. The second transistor M2 may be referred to as a switching transistor, a scan transistor, or the like. The second transistor M2 may be turned on when a scan signal SCANi is supplied to the scan line SCi, to electrically couple the data line Dj and the first node N1 to each other. Accordingly, the second transistor M2 may transfer a data voltage Vdata supplied through the data line Dj to the gate electrode of the first transistor M1 (or the first node N1).

A gate electrode of a third transistor M3 may be coupled to a sensing line SSi, one electrode of the third transistor M3 may be coupled to a receiving line Rj (or a third node N3), and the other electrode of the third transistor M3 may be coupled to the second node N2. The third transistor M3 may be referred to as an initialization transistor, a sensing transistor, or the like. The third transistor M3 may be turned on when a sensing signal SENSEi is supplied to the sensing line SSi, to electrically couple the receiving line Rj and the other electrode of the first transistor M1 to each other.

One electrode of the storage capacitor Cst may be coupled to the first node N1, and the other electrode of the storage capacitor Cst may be coupled to the second node N2. The storage capacitor Cst may store the voltage of the first node N1.

An anode of the light emitting device LD may be coupled to the second node N2, and a cathode of the light emitting device LD may be coupled to the second power line VSS. The light emitting device LD may emit light with a luminance corresponding to an amount of current supplied through the second node N2. The light emitting device LD may be an organic light emitting diode, an inorganic light emitting diode, or the like.

The sensing unit 150 may include an Analog-Digital Converter (ADC) 210, a first switching element SW1, and a second switching element SW2, so as to sense a threshold voltage Vth, a mobility, etc. of the first transistor M1 included in each of the pixels.

The first switching element SW1 may be coupled between the receiving line Rj and an initialization voltage source. The first switching element SW1 may be turned on by an initialization control signal Spre provided from the timing controller 110. Accordingly, an initialization voltage Vint provided from the initialization voltage source may be supplied to the receiving line Rj.

The second switching element SW2 may be coupled between the receiving line Rj and the ADC 210. The second switching element SW2 may be turned on by a sampling signal SAM provided from the timing controller 110, to couple the receiving line Rj to the ADC 210.

Accordingly, the ADC 210 may sense a voltage of the receiving line Rj (or the third node N3). The ADC 210 may sense a voltage stored in a line capacitor Cline electrically coupled to the receiving line Rj or a line capacitor Cline corresponding to a parasitic capacitor component existing in the receiving line Rj. The ADC 210 may generate sensing data by converting the sensed voltage into a digital value, and may transmit the sensing data to the timing controller 110.

That the voltage of the receiving line Rj (or the third node N3) is sensed may be equivalent to that a voltage of the other electrode of the first transistor M1 (or the second node N2) is sensed.

In a sensing period, first, the scan signal SCANi and the sensing signal SENSEi, which have a turn-on level, may be respectively applied to the scan line SCi and the sensing line SSi. The second transistor M2 may be turned on by the scan signal SCANi having the turn-on level, so that the data voltage Vdata for sensing is transferred to the gate electrode of the first transistor M1 (or the first node N1).

In the sensing period, the third transistor M3 may be turned on by the scan signal SENSEi having the turn-on level. The initialization control signal Spre having a turn-on level may be applied to the first switching element SW1, so that the first switching element SW1 is turned on and/or maintains an on state. Accordingly, the initialization voltage Vint is applied to the second node N2.

Subsequently, the initialization control signal Spre having a turn-off level may be applied to the first switching element SW1, so that the first switching element SW1 is turned off. Accordingly, the second node N2 is in a floating state, and thus the voltage of the second node N2 is boosted. The voltage of the second node N2 may be increased up to a value obtained by subtracting a value of the threshold voltage of the first transistor M1 from a value of the voltage (i.e., the data voltage Vdata) of the first node N1.

Subsequently, the sampling signal SAM having a turn-on level may be applied to the second switching element SW2, so that the second switching element SW2 is turned on. The ADC 210 may sense a voltage of the second node N2, generate sensing data by converting the sensed voltage into a digital value, and transmit the sensing data to the timing controller 110.

The timing controller 110 may calculate and store a compensation value for compensating for a characteristic of each of the pixels, based on the sensing data, and perform data compensation processing of grayscale values, a control signal, and the like, which are provided to the data driver 140 (see FIG. 1), based on the compensation value.

Figure 3:
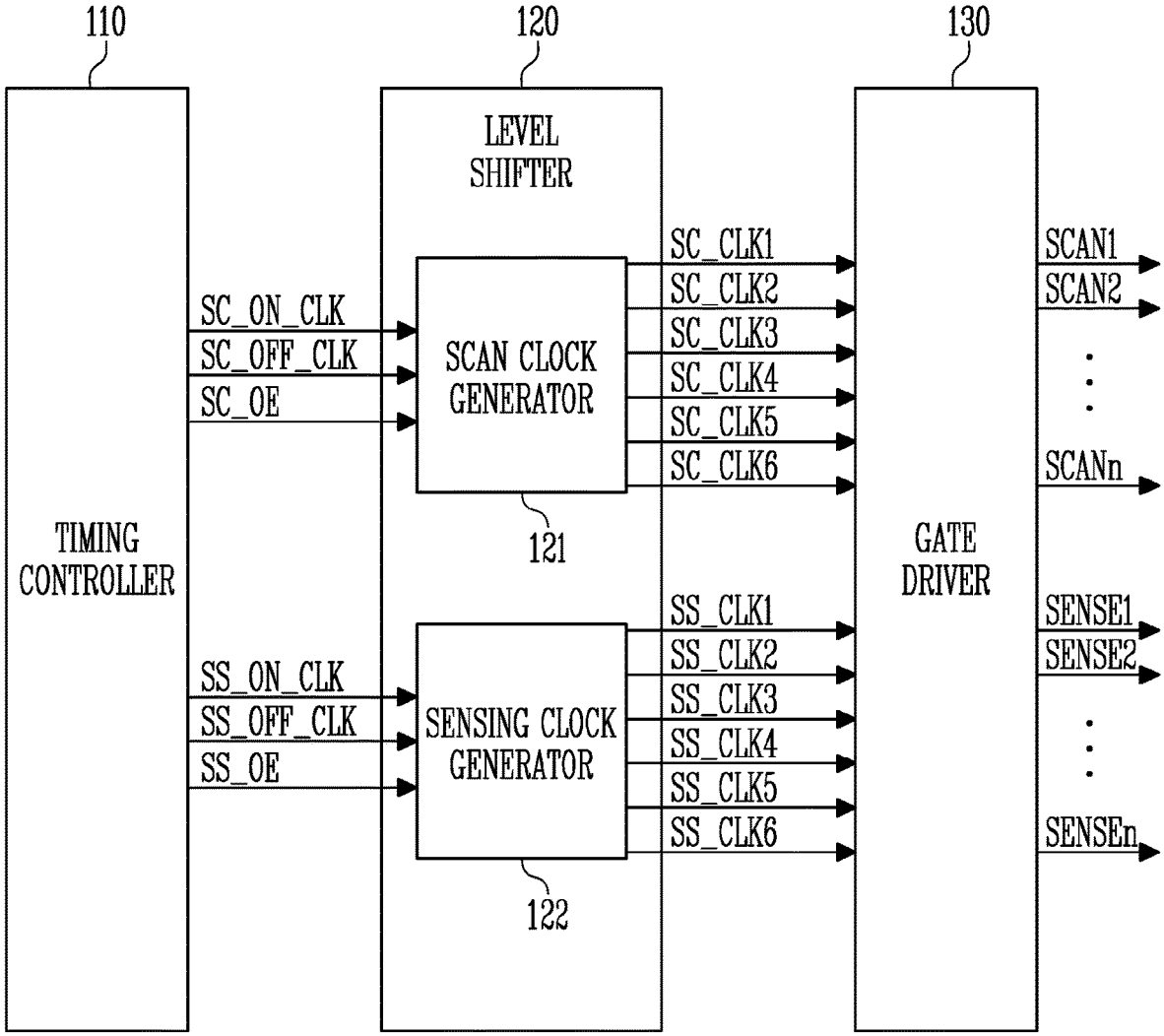
FIG. 3 is a diagram illustrating a timing controller, a level shifter, and a gate driver included in the display device shown in FIG. 1 according to an embodiment.
Figure 4A:
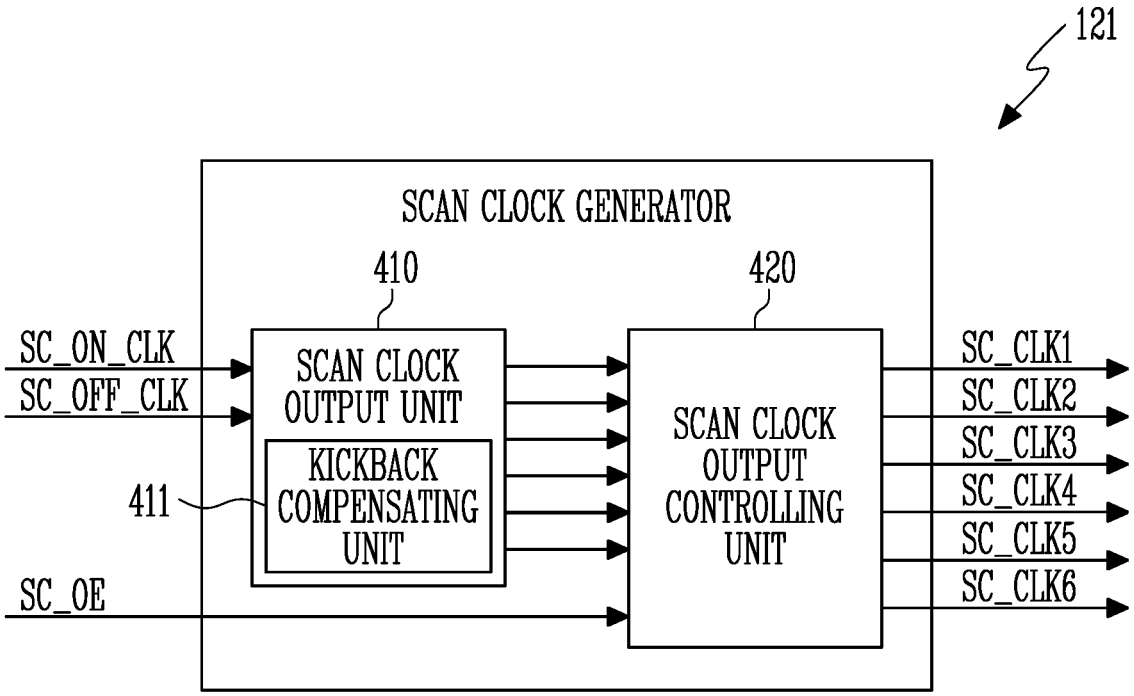
FIG. 4A is a diagram illustrating a scan clock generator included in the level shifter shown in FIG. 3 according to an embodiment.
Figure 4B:
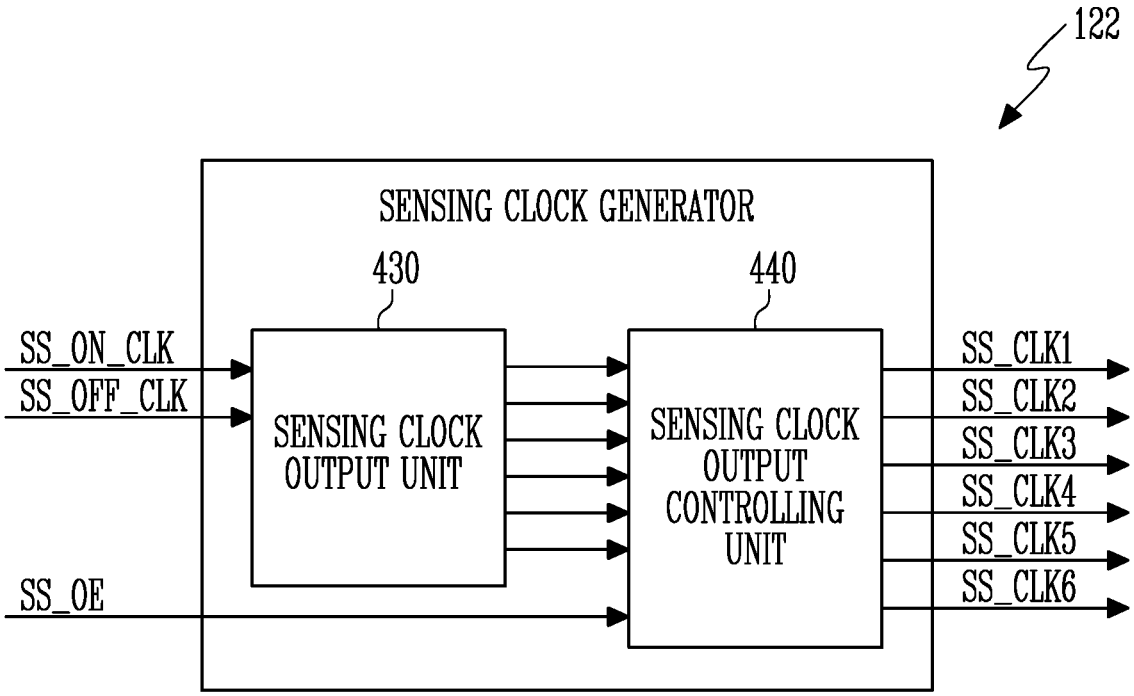
FIG. 4B is a diagram illustrating a sensing clock generator included in the level shifter shown in FIG. 3 according to an embodiment.

FIG. 3 is a diagram illustrating the timing controller, the level shifter, and the gate driver included in the display device shown in FIG. 1 according to an embodiment. FIG. 4A is a diagram illustrating a scan clock generator included in the level shifter shown in FIG. 3 according to an embodiment. FIG. 4B is a diagram illustrating a sensing clock generator included in the level shifter shown in FIG. 3 according to an embodiment.

Referring to FIGS. 3, 4A, and 4B, the timing controller 110 may generate scan-on clock signal SC_ON_CLK (or first on-clock signal), a scan-off clock signal SC_OFF_CLK (or first off-clock signal), a scan output control signal SC_OE (or first output control signal), a sensing-on clock signal SS_ON_CLK (or second on-clock signal), a sensing-off clock signal SS_OFF_CLK (or second off-clock signal), and a sensing output control signal SS_OE (or second output control signal). The scan-on clock signal SC_ON_CLK, the scan-off clock signal SC_OFF_CLK, and the scan output control signal SC_OE may be signals required for the level shifter 120 to generate scan clock signals SC_CLK1, SC_CLK2, SC_CLK3, SC_CLK4, SC_CLK5, and SC_CLK6 (or first gate clock signals), and may be signals periodically having a turn-on voltage level and a turn-off voltage level. The sensing-on clock signal SS_ON_CLK, the sensing-off clock signal SS_OFF_CLK, and the sensing output control signal SS_OE may be signals required for the level shifter 120 to generate sensing clock signals SS_CLK1, SS_CLK2, SS_CLK3, SS_CLK4, SS_CLK5, and SS_CLK6 (or second gate clock signals), and may be signals periodically having a turn-on voltage level and a turn-off voltage level.

The timing controller 110 may further generate a start pulse signal for controlling an operation time of the level shifter 120 and a reset pulse signal for controlling a reset time of the level shifter 120, and may provide the start pulse signal and the reset pulse signal to the level shifter 120.

The level shifter 120 may include a scan clock generator 121 and a sensing clock generator 122. The scan clock generator 121 may generate the scan clock signals SC_CLK1, SC_CLK2, . . . , and SC_CLK6, based on the scan-on clock signal SC_ON_CLK, the scan-off clock signal SC_OFF_CLK, and the scan output control signal SC_OE, which are provided from the timing controller 110, may shift a voltage level of each of the scan clock signals SC_CLK1, SC_CLK2, . . . , and SC_CLK6 to a voltage level at which the transistors included in the pixels are operable, and may provide the shifted voltage levels to the gate driver 130. The sensing clock generator 122 may generate the sensing clock signals SS_CLK1, SS_CLK2, . . . , and SS_CLK6, based on the sensing-on clock signal SS_ON_CLK, the sensing-off clock signal SS_OFF_CLK, and the sensing output control signal SS_OE, which are provided from the timing controller 110, may shift a voltage level of each of the sensing clock signals SS_CLK1, SS_CLK2, . . . , and SS_CLK6 to a voltage level at which the transistors included in the pixels are operable, and may provide the shifted voltage levels to the gate driver 130.

Referring to FIG. 4A, the scan clock generator 121 may include a scan clock output unit 410 (or first gate clock output unit) and a scan clock output controlling unit 420 (or first gate clock output controlling unit). The scan clock output unit 410 may include a kickback compensating unit 411.

The scan clock output unit 410 may generate the scan clock signals SC_CLK1, SC_CLK2, . . . , and SC_CLK6, based on the scan-on clock signal SC_ON_CLK and the scan-off clock signal SC_OFF_CLK, in a display period and a sensing period.

In an embodiment, the scan clock generator 121 may generate the scan clock signals SC_CLK1, SC_CLK2, . . . , and SC_CLK6 each having a rising edge and a falling edge, which respectively correspond to a rising edge of the scan-on clock signal SC_ON_CLK and a falling edge of the scan-off clock signal SC_OFF_CLK.

The kickback compensating unit 411 may control each of the scan clock signals SC_CLK1, SC_CLK2, . . . , and SC_CLK6 to include a Gate Pulse Modulation (hereinafter referred to as "GPM") period at a falling edge of pulses included in each of the scan clock signals SC_CLK1, SC_CLK2, . . . , and SC_CLK6, based on the scan-off clock signal SC_OFF_CLK. Thus, a kickback phenomenon occurring in the pixel can be compensated.

In a sensing period, the scan clock output controlling unit 420 may divide/change each of the pulses included in each of the scan clock signals SC_CLK1, SC_CLK2, . . . , and SC_CLK6 into a plurality of pulses (or sub-pulses) by partially and temporarily blocking each of the pulses included in each of the scan clock signals SC_CLK1, SC_CLK2, . . . , and SC_CLK6, based on the scan output control signal SC_OE.

Each frame may include a display period in which each of the pixels emits light in response to a data signal supplied through a corresponding data line and a scan signal supplied through a corresponding scan line, and may include a sensing period in which the sensing unit 150 (see FIG. 2) updates a compensation value of the pixels by sensing characteristic information of the pixels.

Referring to FIG. 4B, the sensing clock generator 122 may include a sensing clock output unit 430 (or second gate clock output unit) and a sensing clock output controlling unit 440 (or second gate clock output controlling unit).

The sensing clock output unit 430 may generate the sensing clock signals SS_CLK1, SS_CLK2, . . . , and SS_CLK6, based on the sensing-on clock signal SS_ON_CLK and the sensing-off clock signal SS_OFF_CLK, in a display period and a sensing period.

In an embodiment, the sensing clock generator 122 may generate the sensing clock signals SS_CLK1, SS_CLK2, . . . , and SS_CLK6 each having a rising edge and a falling edge, which respectively correspond to a rising edge of the sensing-on clock signal SS_ON_CLK and a falling edge of the sensing-off clock signal SS_OFF_CLK.

The sensing clock output controlling unit 440 may divide/change each of pulses included in each of the sensing clock signals SS_CLK1, SS_CLK2, . . . , and SS_CLK6 into a plurality of pulses (or sub-pulses) by partially and temporarily blocking each of the pulses included in each of the sensing clock signals SS_CLK1, SS_CLK2, . . . , and SS_CLK6, based on the sensing output control signal SS_OE.

Referring to FIGS. 1, 3, 4A, and 4B, the gate driver 130 generate scan signals SCAN1, SCAN2, . . . , and SCANn (or first gate signals), based on the scan clock signals SC_CLK1, SC_CLK2, . . . , and SC_CLK6, and provide the generated scan signals SCAN1, SCAN2, . . . , and SCANn to the corresponding scan lines SC1, SC2, . . . , and SCn. The gate driver 130 may generate sensing signals SENSE1, SENSE2, . . . , SENSEn (or second gate signals), based on the sensing clock signals SS_CLK1, SS_CLK2, . . . , and SS_CLK6, and provide the generated sensing signals SENSE1, SENSE2, . . . , SENSEn to the corresponding sensing lines SS1, SS2, . . . , and SSn.

The level shifter 120 including the scan clock generator 121 and the sensing clock generator 122 may generate the scan clock signals SC_CLK1, SC_CLK2, . . . , and SC_CLK6 using only the scan-on clock signal SC_ON_CLK, the scan-off clock signal SC_OFF_CLK, and the scan output control signal SC_OE, and may generate the sensing clock signals SS_CLK1, SS_CLK2, . . . , and SS_CLK6 using only the sensing-on clock signal SS_ON_CLK, the sensing-off clock signal SS_OFF_CLK, and the sensing output control signal SS_OE, so that each of a number of signal lines between the timing controller 110 and the level shifter 120, a number of output pins of the timing controller 110, and a number of input pins of the level shifter 120 can be minimized and can be less than the sum of the numbers of scan and sensing clock signals.

Figure 5:
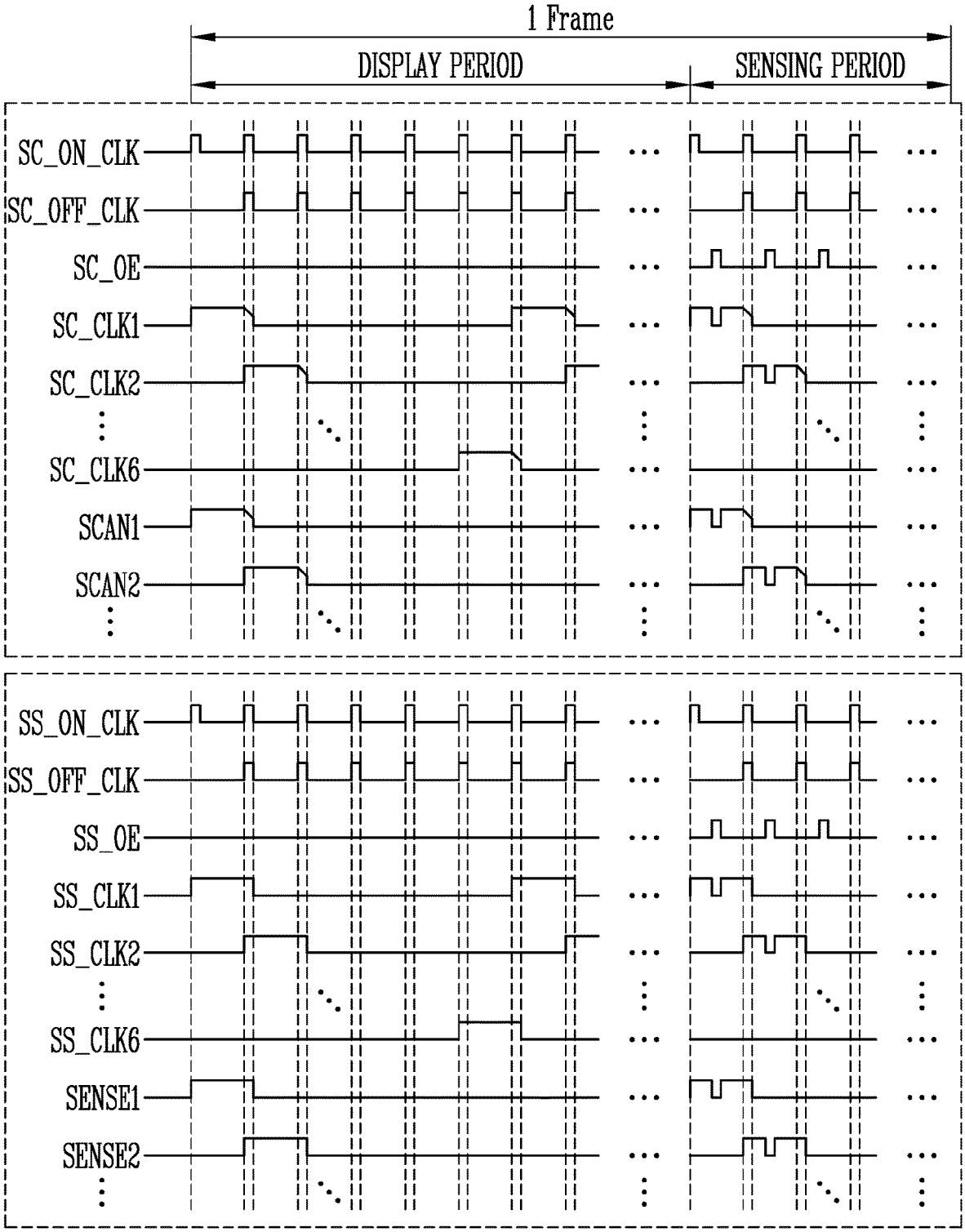
FIG. 5 is a diagram illustrating the gate driver shown in FIG. 3 and signals related to and/or measured in the gate driver according to an embodiment.

FIG. 5 is a diagram illustrating the gate driver shown in FIG. 3 and signals related to and/or measured in the gate driver according to an embodiment.

Referring to FIG. 5, one frame 1 Frame may include a display period DISPLAY PERIOD and a sensing period SENSING PERIOD.

In the display period DISPLAY PERIOD and the sensing period SENSING PERIOD, each of the scan-on and sensing-on clock signals SC_ON_CLK and SS_ON_CLK may include a plurality of pulses formed according to a predetermined period. Each of the scan-off and sensing-off clock signals SC_OFF_CLK and SS_OFF_CLK may have the same period as each of the scan-on and sensing-on clock signals SC_ON_CLK and SS_ON_CLK, and may include pulses formed at the same times as (i.e., synchronized with) the pulses of each of the scan-on and sensing-on clock signals SC_ON_CLK and SS_ON_CLK.

Each of the scan and sensing output control signals SC_OE and SS_OE may be maintained at a logic low level in the display period DISPLAY PERIOD, and may have pulses that have a predetermined period in the sensing period SENSING PERIOD. In the sensing period SENSING PERIOD, each of the scan and sensing output control signals SC_OE and SS_OE may include pulses which have the same period as each of the scan-on and sensing-on clock signals SC_ON_CLK and SS_ON_CLK and each of the scan-off and sensing-off clock signals SC_OFF_CLK and SS_OFF_CLK, but are formed at times different from (i.e., not synchronized with) the times of the pulses of each of the scan-on and sensing-on clock signals SC_ON_CLK and SS_ON_CLK and the pulses of each of the scan-off and sensing-off clock signals SC_OFF_CLK and SS_OFF_CLK.

Referring to FIGS. 3, 4A, and 5, in the display period DISPLAY PERIOD and the sensing period SENSING PERIOD, the scan clock output unit 410 may generate a rising edge of a first scan clock signal SC_CLK1, corresponding to a rising edge of a first pulse included in the scan-on clock signal SC_ON_CLK, and may generate a falling edge of the first scan clock signal SC_CLK1, corresponding to a falling edge of a first pulse included in the scan-off clock signal SC_OFF_CLK. Accordingly, the first scan clock signal SC_CLK1 may have a pulse of a logic high level, corresponding to the rising edge of the first pulse included in the scan-on clock signal SC_ON_CLK and the falling edge of the first pulse included in the scan-off clock signal SC_OFF_CLK. The first scan clock signal SC_CLK1 may have pulses of a logic high level in a period of six pulses/periods of the scan-on clock signal SC_ON_CLK. Similarly, the scan clock output unit 410 may generate a rising edge of a second scan clock signal SC_CLK2, corresponding to a rising edge of a second pulse included in the scan-on clock signal SC_ON_CLK, and may generate a falling edge of the second scan clock signal SC_CLK2, corresponding to a falling edge of a second pulse included in the scan-off clock signal SC_OFF_CLK. That is, the second scan clock signal SC_CLK2 may have a waveform equivalent to that the first scan clock signal SC_CLK1 is shifted by one period of the scan-on clock signal SC_ON_CLK. Third to sixth scan clock signals SC_CLK3 to SC_CLK6 shown in FIG. 5 may also be generated similarly to the first and second scan clock signals SC_CLK1 and SC_CLK2.

In the display period DISPLAY PERIOD and the sensing period SENSING PERIOD, the kickback compensating unit 411 may control each of the scan clock signals SC_CLK1, SC_CLK2, . . . , and SC_CLK6 to include a GPM period at a falling edge of each of the pulses included in each of the scan clock signals SC_CLK1, SC_CLK2, . . . , and SC_CLK6. Each GPM period may be equal/equivalent to a period from a rising edge of the scan-off clock signal SC_OFF_CLK to a falling edge of the scan-off clock signal SC_OFF_CLK.

In an embodiment, the first scan clock signal SC_CLK1 may include a GPM period with a gradually decreasing signal level of the first scan clock signal SC_CLK1 and corresponding to the first pulse included in the scan-off clock signal SC_OFF_CLK. Similarly, the second scan clock signal SC_CLK2 may include GPM period with a gradually decreasing signal level of the second scan clock signal SC_CLK2 and corresponding to the second pulse included in the scan-off clock signal SC_OFF_CLK. Like the first and second scan clock signals SC_CLK1 and SC_CLK2, each of the third to sixth scan clock signals SC_CLK3 to SC_CLK6 shown in FIG. 5 may also include a GPM period.

When the scan output control signal SC_OE has a pulse of a logic high level, the scan clock output controlling unit 420 may control outputs of the scan clock signals SC_CLK1, SC_CLK2, . . . , and SC_CLK6. Accordingly, the scan clock generator 121 may provide the gate driver 130 with scan clock signals SC_CLK1, SC_CLK2, . . . , and SC_CLK6 generated in the scan clock output unit 410 in the display period DISPLAY PERIOD as they are.

The scan clock generator 121 may control scan clock signals SC_CLK1, SC_CLK2, . . . , and SC_CLK6 generated in the scan clock output unit 410 in the sensing period SENSING PERIOD through the scan clock output controlling unit 420, and may provide the scan clock signals SC_CLK1, SC_CLK2, . . . , and SC_CLK6 to the gate driver 130.

Figure 6A:
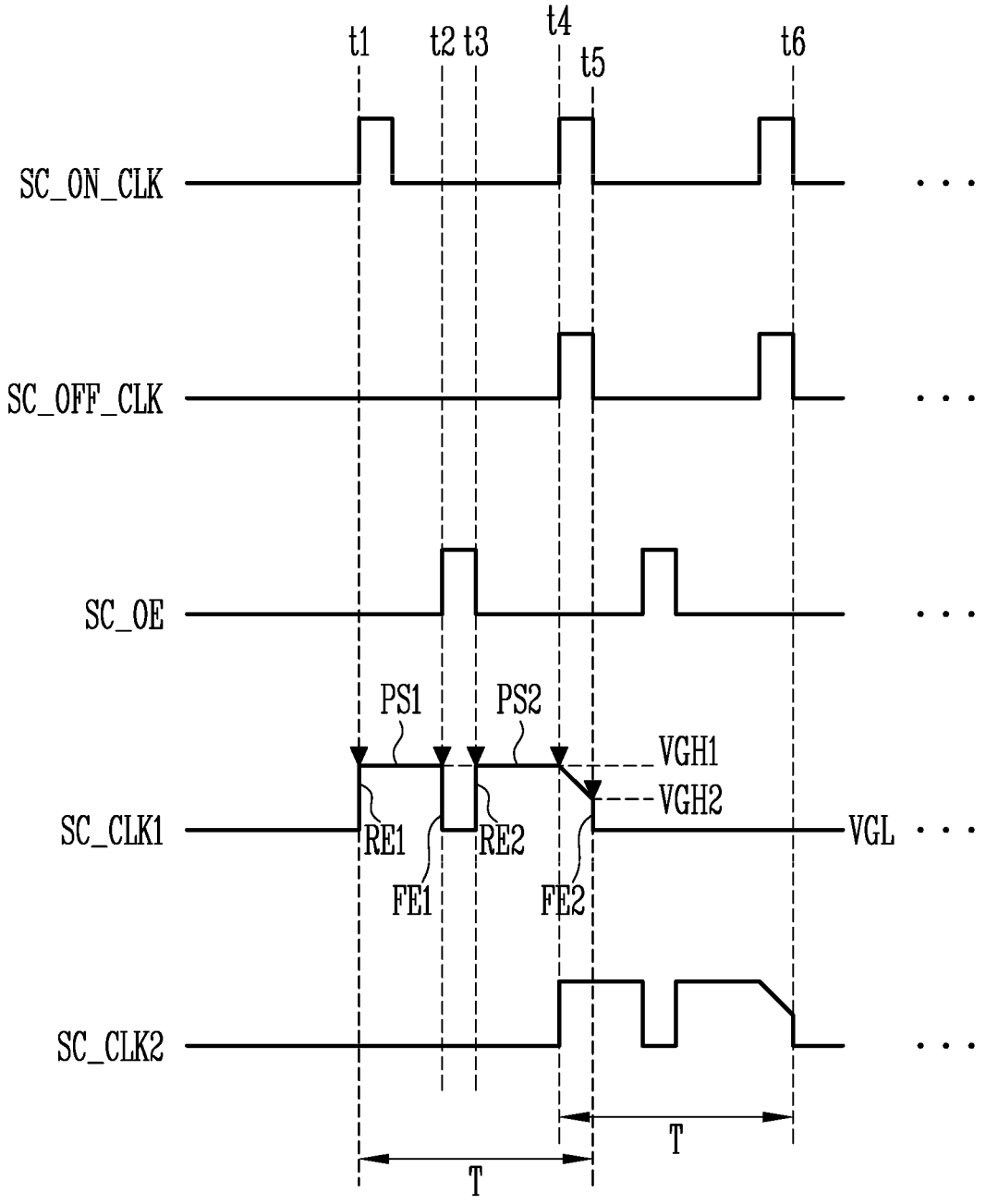
FIG. 6A is a diagram illustrating signals related to and/or measured in the scan clock generator shown in FIG. 4A in a sensing period according to an embodiment.

Referring to FIGS. 4A, 5, and 6A, in the sensing period SENSING PERIOD, the scan clock output controlling unit 420 may divide/change one pulse included in each of the scan clock signals SC_CLK1, SC_CLK2, . . . , and SC_CLK6 into two pulses PS1 and PS2, based on the scan output control signal SC_OE. The scan output control signal SC_OE may not significantly overlap with each of the divided pulses PS1 and PS2.

In an embodiment, in the sensing period SENSING PERIOD, the first scan clock signal SC_CLK1 may be maintained at a logic low level during a first pulse of the scan output control signal SC_OE. Similarly, the second scan clock signal SC_CLK2 may be maintained at a logic low level during a second pulse of the scan output control signal SC_OE. The third to sixth scan clock signals SC_CLK3 to SC_CLK6 shown in FIG. 5 may have low-level periods similarly to the above-described low-level periods of the first and second scan clock signals SC_CLK1 and SC_CLK2.

In the display period DISPLAY PERIOD, the gate driver 130 may generate scan signals SCAN1, SCAN2, . . . , and SCANn, corresponding to the scan clock signals SC_CLK1, SC_CLK2, . . . , and SC_CLK6 provided from the scan clock generator 121.

Referring to FIG. 5, a pulse of a first scan signal SCAN1, which has a logic high level, may be formed corresponding to a first pulse of the first scan clock signal SC_CLK1, which has a logic high level. The pulse of the first scan signal SCAN1 may have a waveform substantially identical to that of the first pulse of the first scan clock signal SC_CLK1. Similarly, a pulse of a second scan signal SCAN2, which has a logic high level, may be formed corresponding to a first pulse of the second scan clock signal SC_CLK2, which has a logic high level. The pulse of the second scan signal SCAN2 may have a waveform substantially identical to that of the first pulse of the second scan clock signal SC_CLK2. Third to sixth scan signals may also be formed similarly to the first and second scan signals SCAN1 and SCAN2.

A pulse of a seventh scan signal, which has a logic high level, may be formed corresponding to a second pulse of the first scan clock signal SC_CLK1, which has a logic high level. The pulse of the seventh scan signal may have a waveform substantially identical to that of the second pulse of the first scan clock signal SC_CLK1. Each of eighth to nth scan signals may also be formed similarly to one of the first to seventh scan signals, so that the first to nth scan signals SCAN1, SCAN2, . . . , and SCANn sequentially have a pulse of a logic high level (or turn-on level).

Like the display period DISPLAY PERIOD, in the sensing period SENSING PERIOD, the gate driver 130 may generate scan signals SCAN1, SCAN2, . . . , and SCANn, corresponding to the scan clock signals SC_CLK1, SC_CLK2, . . . , and SC_CLK6 provided from the scan clock generator 121.

Referring to FIGS. 3 to 5, the sensing clock generator 122 shown in FIG. 4B may not include the kickback compensating unit 411 described with reference to FIG. 4A. Accordingly, each of the sensing clock signals SS_CLK1, SS_CLK2, . . . , and SS_CLK6 and the sensing signals SENSE1, SENSE2, . . . , and SENSE6 shown in FIG. 5, may not include a GPM period at a falling edge. Except the GPM period, the sensing clock signals SS_CLK1, SS_CLK2, . . . , and SS_CLK6 and the sensing signals SENSE1, SENSE2, . . . , and SENSE6 are substantially identical or similar, respectively, to the scan clock signals SC_CLK1, SC_CLK2, . . . , SC_CLK6 and the scan signals SCAN1, SCAN2, . . . , and SCANn described with reference to FIGS. 3, 4A, and 5.

Referring to FIGS. 2 to 5, each of the scan signals SCAN1, SCAN2, . . . , and SCANn and the sensing signals SENSE1, SENSE2, . . . , and SENSEn supplied in the sensing period SENSING PERIOD included in the one frame 1 Frame may include two pulses. When a first pulse of the two pulses included in each of the scan signals SCAN1, SCAN2, . . . , and SCANn and the sensing signals SENSE1, SENSE2, . . . , and SENSEn is applied, the first and second nodes N1 and N2 of the first transistor M1 may be initialized.

Referring to FIG. 2, a scan signal SCANi and a sensing signal SENSEi with a turn-on level may be respectively applied to the scan line SCi and the sensing line SSi, so that the second and third transistors M2 and M3 are turned on.

A black data voltage may be applied to the data line Dj, so that the first node N1 of the first transistor M1 may initialized to the black data voltage. The black data voltage may prevent the pixels from emitting light. When the black data voltage is applied to the first node N1 of the first transistor M1, the first transistor M1 may be turned off, so that the pixel PXij emits no light. The black data voltage may cause a voltage between a gate and a source of the first transistor M1 to be lower than the threshold voltage.

When the first switching element SW1 is turned on according to the initialization control signal Spre having a turn-on level, the initialization voltage Vint may be applied to the third node N3, so that the second node N2 is initialized to the initialization voltage Vint.

Subsequently, when a second pulse of the two pulses included in each of the scan signals SCAN1, SCAN2, . . . , and SCANn and the sensing signals SENSE1, SENSE2, . . . , and SENSEn is applied, the sensing operation described with reference to FIG. 2 may be performed.

As described with reference to FIGS. 2 to 5, each of the scan signals SCAN1, SCAN2, . . . , and SCANn and the sensing signals SENSE1, SENSE2, . . . , and SENSEn may have two pulses, based on the scan and sensing output control signals SC_OE and SS_OE each including pulses of a logic high level in the sensing period SENSING PERIOD. Accordingly, the sensing unit 150 may perform an operation of initializing the first and second nodes N1 and N2 of the first transistor M1, before the sensing unit 150 senses a characteristic of the pixels in the sensing period SENSING PERIOD.

FIG. 6A is a diagram illustrating signals related to and/or measured in the scan clock generator shown in FIG. 4A in the sensing period according to an embodiment.

Referring to FIGS. 3, 4A, 5, and 6A, at a first time t1, a rising edge of the first pulse included in the scan-on clock signal SC_ON_CLK may be generated. The scan clock output unit 410 may generate a first rising edge RE1 of a first pulse PS1 included in the first scan clock signal SC_CLK1 based on the rising edge of the first pulse included in the scan-on clock signal SC_ON_CLK. Accordingly, the first scan clock signal SC_CLK1 may be increased from a third level VGL to a first level VGH1. The first level VGH1 may be higher than the third level VGL.

At a second time t2, a rising edge of the first pulse included in the scan output control signal SC_OE may be generated. The scan clock output controlling unit 420 may generate a first falling edge FE1 of the first pulse PS1 included in the first scan clock signal SC_CLK1 by controlling an output of the first scan clock signal SC_CLK1 (by temporarily and partially blocking a pulse included in the first scan clock signal SC_CLK1), based on the rising edge of the first pulse included in the scan output control signal SC_OE. Accordingly, the first scan clock signal SC_CLK1 may be decreased from the first level VGH1 to the third level VGL.

At a third time t3, a falling edge of the first pulse included in the scan output control signal SC_OE may be generated. The scan clock output controlling unit 420 may generate a second rising edge rE2 of a second pulse PS2 included in the first scan clock signal SC_CLK1 by suspending the controlling of the output of the first scan clock signal SC_CLK1 (e.g., by stopping/removing the blocking of the pulse included in the first scan clock signal SC_CLK1), based on the falling edge of the first pulse included in the scan output control signal SC_OE. Accordingly, the first scan clock signal SC_CLK1 may be increased from the third level VGL to the first level VGH1.

At a fourth time t4, a rising edge of the first pulse included in the scan-off clock signal SC_OFF_CLK may be generated. At a fifth time t5, a falling edge of the first pulse included in the scan-off clock signal SC_OFF_CLK may be generated. From the fourth time t4 to the fifth time t5, the kickback compensating unit 411 may gradually decrease the second pulse PS2 included in the first scan clock signal SC_CLK1 from the first level VGH1 to a second level VGH2, based on the rising edge and the falling edge of the first pulse included in the scan-off clock signal SC_OFF_CLK. For example, from the fourth time t4 to the fifth time t5, the second pulse PS2 may linearly or exponentially decrease from the first level VGH1 to the second level VGH2. The second level VGH2 may be lower than the first level VGH1 and higher than the third level VGL.

At the fifth time t5, the scan clock output unit 410 may generate a second falling edge FE2 of the second pulse PS2 included in the first scan clock signal SC_CLK1, based on the falling edge of the first pulse included in the scan-off clock signal SC_OFF_CLK. Accordingly, the first scan clock signal SC_CLK1 may be decreased from the second level VGH2 to the third level VGL.

Therefore, the first scan clock signal SC_CLK1 may include the first pulse PS1 of a logic high level, from t1 to t2 (i.e., from a time of the falling edge of the first pulse included in the scan-on clock signal SC_ON_CLK to a time of the rising edge of the first pulse included in the scan output control signal SC_OE) and may include the second pulse PS2 of a logic high level from t3 to t5 (i.e., from a time of the falling edge of the first pulse included in the scan output control signal SC_OE to a time of the falling edge of the first pulse included in the scan-off clock signal SC_OFF_CLK). The second pulse PS2 may include a GPM period in which the second pulse PS2 is decreased from the first level VGH1 to the second level VGH2; the GPM is from t4 to t5 (i.e., from a time of the rising edge of the first pulse included in the scan-off clock signal SC_OFF_CLK to the time of the falling edge of the first pulse included in the scan-off clock signal SC_OFF_CLK). The second pulse PS2 may decrease from the second level VGH2 to the third level VGL at the time of the falling edge of the first pulse included in the scan-off clock signal SC_OFF_CLK.

In addition, at the fourth time t4, a rising edge of the second pulse included in the scan-on clock signal SC_ON_CLK may be generated. At a sixth time t6, a falling edge of the third pulse included in the scan-on clock signal SC_ON_CLK may be generated. From the fourth time t4 to the sixth time t6, the second scan clock signal SC_CLK2 may be formed similarly to the first scan clock signal SC_CLK1 formed from t1 to t5.

In the display period DISPLAY PERIOD shown in FIG. 5, the scan output control signal SC_OE does not include a pulse of a logic high level, and is maintained at a logic low level. Therefore, the scan clock signals SC_CLK1, SC_CLK2, . . . , SC_CLK6 may not be temporarily blocked and may have more high-level time than those in the sensing period SENSING PERIOD.

Figure 6B:
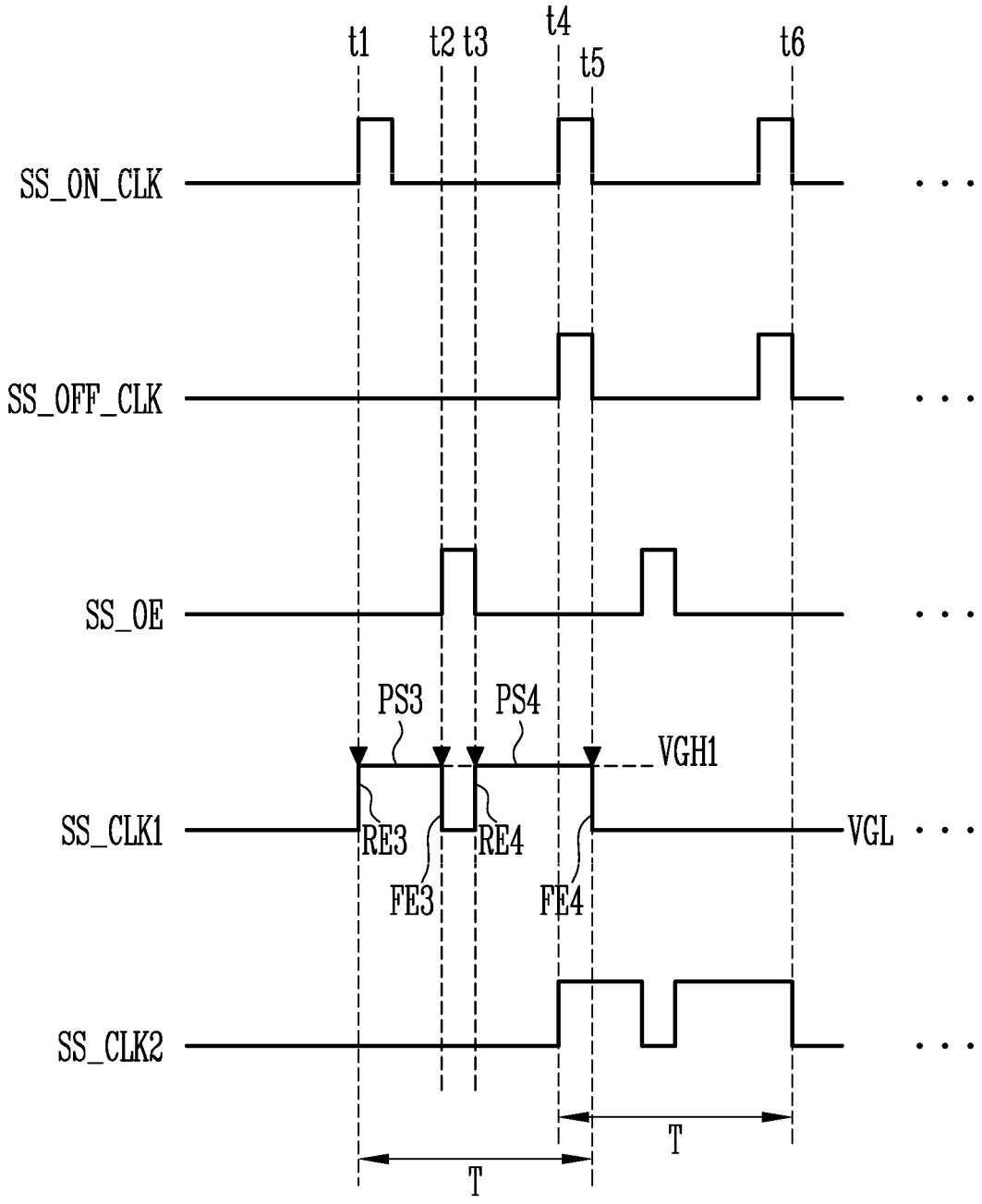
FIG. 6B is a diagram illustrating signals related to and/or measured in the sensing clock generator shown in FIG. 4B in the sensing period according to an embodiment.

FIG. 6B is a diagram illustrating signals related to and/or measured in the sensing clock generator shown in FIG. 4B in the sensing period according to an embodiment.

Referring to FIGS. 3 to 6B, the sensing clock signals SS_CLK1, SS_CLK2, . . . , and SS_CLK6 are generated substantially identically or similarly to the scan clock signals SC_CLK1, SC_CLK2, . . . , and SC_CLK6 described with reference to FIGS. 3, 4A, 5, and 6A, except that each of the sensing clock signals SS_CLK1, SS_CLK2, . . . , and SS_CLK6 shown in FIGS. 5 and 6B does not include a GPM period at a falling edge of a corresponding one of the sensing clock signals SS_CLK1, SS_CLK2, . . . , and SS_CLK6.

Referring to FIGS. 5, 6A, and 6B, each of the scan-on and sensing-on clock signals SC_ON_CLK and SS_ON_CLK may include a plurality of pulses according to a predetermined period. Each of the scan-off and sensing-off clock signals SC_OFF_CLK and SS_OFF_CLK may have the same period as the scan-on and sensing-on clock signals SC_ON_CLK and SS_ON_CLK, and may include pulses that are synchronized with those of each of the scan-on and sensing-on clock signals SC_ON_CLK and SS_ON_CLK. Each of first pulses included in each of the scan-off and sensing-off clock signals SC_OFF_CLK and SS_OFF_CLK may be synchronized with each of second pulses included in each of the scan-on and sensing-on clock signals SC_ON_CLK and SS_ON_CLK.

Accordingly, during a period T from the first time t1 to the fifth time t5, pulses of each of the first scan and sensing clock signals SC_CLK1 and SS_CLK1 may be formed. During a period T from the fourth time t4 to the sixth time t6, pulses of each of the second scan and sensing clock signals SC_CLK2 and SS_CLK2 may be formed. A length of the period T from the first time t1 to the fifth time t5 may be equal to a length of the period T from the fourth time t4 to the sixth time t6. Each of the second scan and sensing clock signals SC_CLK2 and SS_CLK2 may overlap with each of the first scan and sensing clock signals SC_CLK1 and SS_CLK1 in from the fourth time t4 to the fifth time t5.

In an embodiment, the first pulses included in each of the scan-off and sensing-off clock signals SC_OFF_CLK and SS_OFF_CLK may be synchronized with each of third pulses included in each of the scan-on and sensing-on clock signals SC_ON_CLK and SS_ON_CLK. Accordingly, a length of the period in which the first scan and sensing clock signals SC_CLK1 and SS_CLK1 and the second scan and sensing clock signals SC_CLK2 and SS_CLK2 overlap with each other may be increased.

Figure 6C:
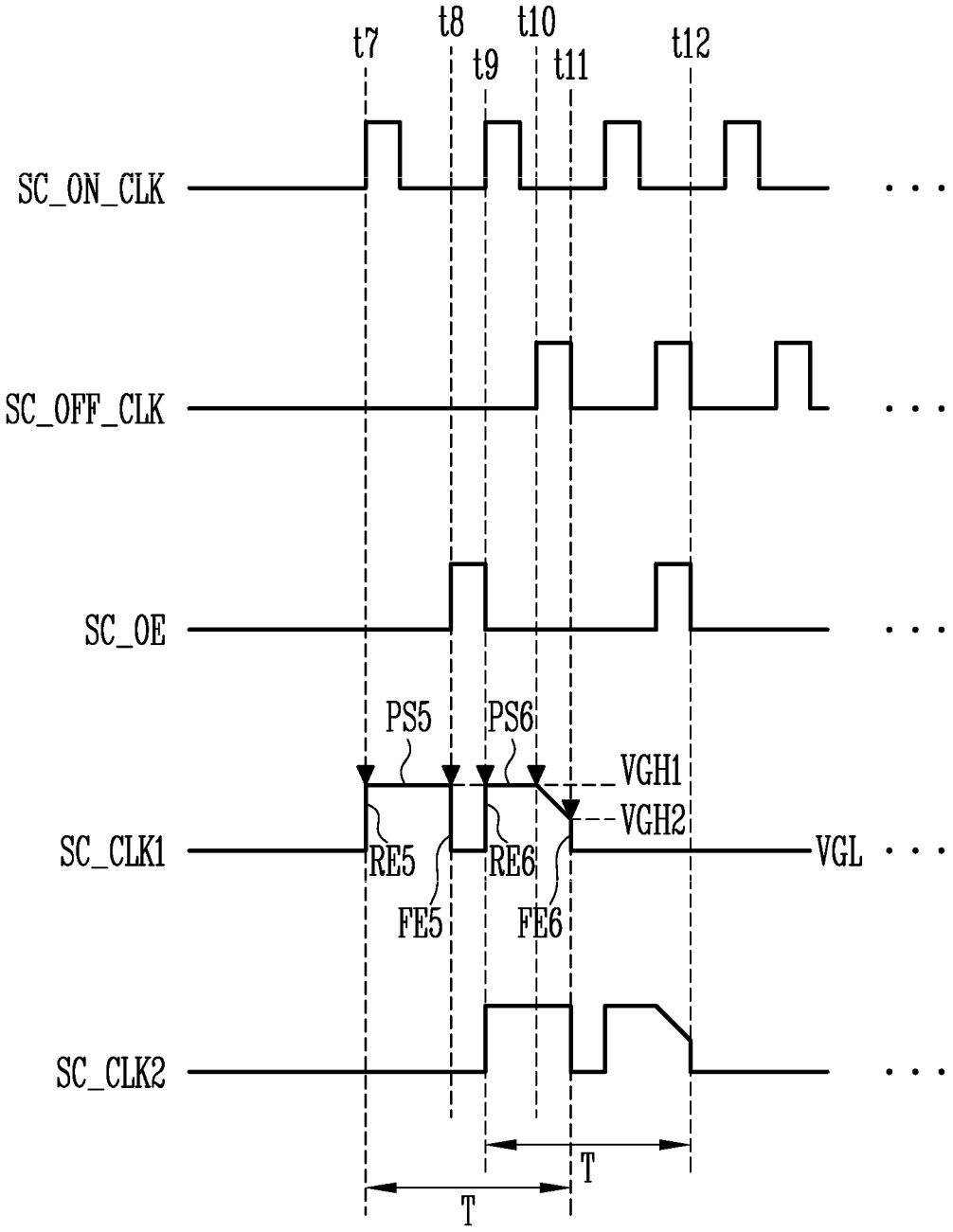
FIG. 6C is a diagram illustrating signals related to and/or measured in the scan clock generator shown in FIG. 4A in the sensing period according to an embodiment.

FIG. 6C is a diagram illustrating signals related to and/or measured in the scan clock generator shown in FIG. 4A in the sensing period according to an embodiment.

Referring to FIG. 6C, the scan-on clock signal SC_ON_CLK may include a plurality of pulses according to a predetermined period. The scan-off clock signal SC_OFF_CLK may include a plurality of pulses according to the same period as the scan-on clock signal SC_ON_CLK but are not synchronized with the pulses of the scan-on clock signal SC_ON_CLK. A first pulse included in the scan-off clock signal SC_OFF_CLK may be formed between a time of a second pulse included in the scan-on clock signal SC_ON_CLK and a time of a third pulse included in the scan-on clock signal SC_ON_CLK. Accordingly, during a period T from a seventh time t7 to an eleventh time t11, a pulse of the first scan clock signal SC_CLK1 may be formed. During a period T from a ninth time t9 to a twelfth time t12, a pulse of the second scan clock signal SC_CLK2 may be formed. A length of the period T from the seventh time t7 to the eleventh time t11 may be equal to a length of the period from the ninth time t9 to the twelfth time t12. The second clock signal SC_CLK2 may overlap with the first scan clock signal SC_CLK1 from the ninth time t9 to the eleventh time t11. Accordingly, a length in which the first scan clock signal SC_CLK1 and the second scan clock signal SC_CLK2 overlap with each other may be increased.

The sensing clock signals may be formed substantially identically to the scan clock signals described with reference to FIG. 6C, except that each of the sensing clock signals does not include a GPM period at a falling edge of the pulses included in a corresponding one of the sensing clock signals.

Figure 6D:
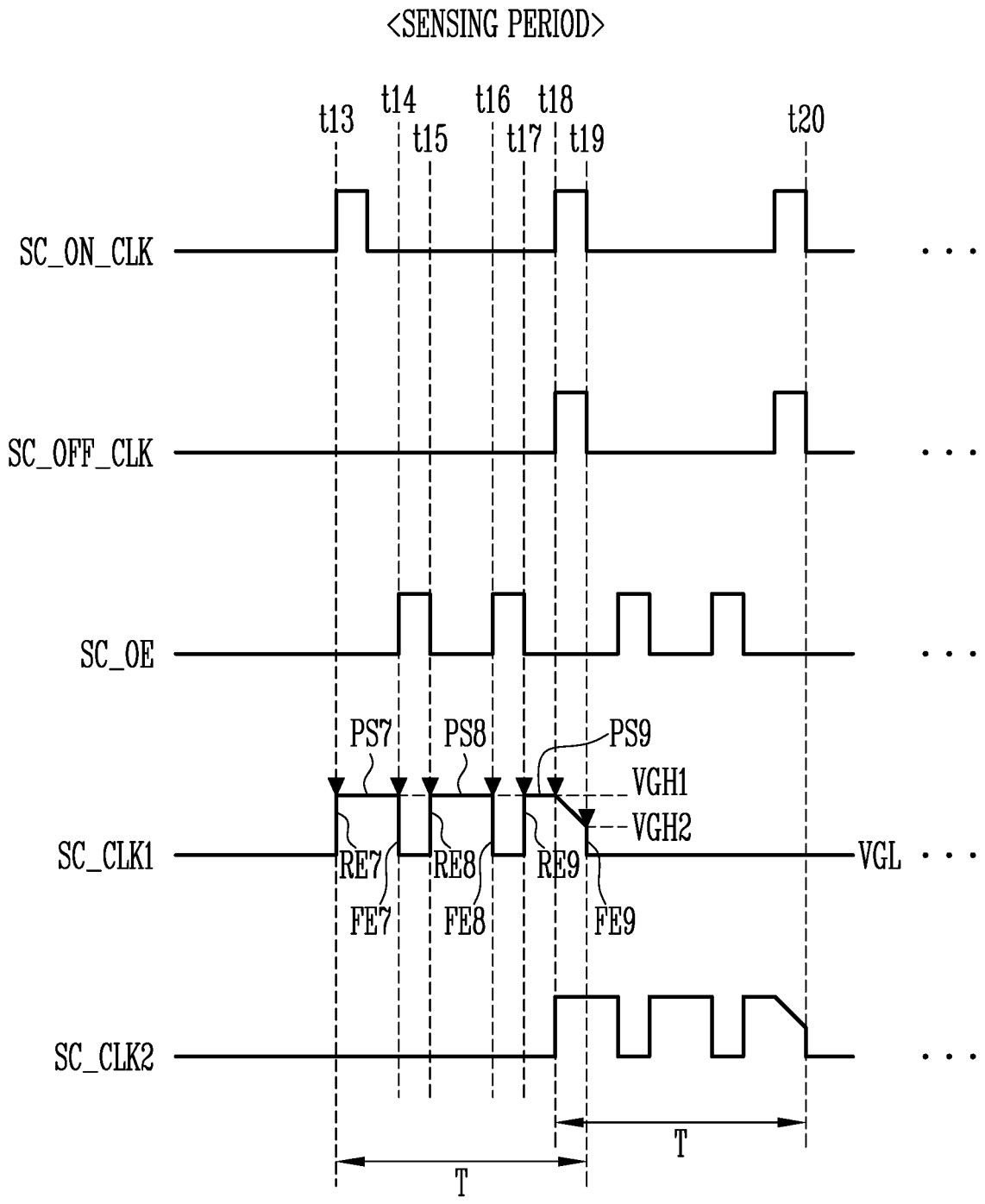
FIG. 6D is a diagram illustrating signals related to and/or measured in the scan clock generator shown in FIG. 4A in the sensing period according to an embodiment.

FIG. 6D is a diagram illustrating signals related to and/or measured in the scan clock generator shown in FIG. 4A in the sensing period according to an embodiment.

Referring to FIG. 6D, during a period from a time of a rising edge of the first pulse included in the scan-on clock signal SC_ON_CLK to a time of a falling edge of the first pulse included in the scan-off clock signal SC_OFF_CLK, the scan output control signal SC_OE may include two pulses of a logic high level. Accordingly, each of the pulses included in each of the scan clock signals may be temporarily and partially blocked twice and may be changed into three pulses.

Referring to FIGS. 3, 4A, 5, and 6D, at a thirteenth time t13, a rising edge of the first pulse included in the scan-on clock signal SC_ON_CLK may be generated. The scan clock output unit 410 may generate a seventh rising edge RE7 of a seventh pulse PS7 included in the first scan clock signal SC_CLK1, based on the rising edge of the first pulse included in the scan-on clock signal SC_ON_CLK. Accordingly, the first scan clock signal SC_CLK1 may be increased from a third level VGL to a first level VGH1. The first level VHG1 may be higher than the third level VGL.

At a fourteenth time t14, a rising edge of the first pulse included in the scan output control signal SC_OE may be generated. The scan clock output controlling unit 420 may generate a seventh falling edge FE7 of the seventh pulse PS7 included in the first scan clock signal SC_CLK1 by controlling an output of the first scan clock signal SC_CLK1 (e.g., by temporarily blocking a pulse included in the first scan clock signal SC_CLK1), based on the rising edge of the first pulse included in the scan output control signal SC_OE. Accordingly, the first scan clock signal SC_CLK1 may be decreased from the first level VGH1 to the third level VGL.

At a fifteenth time t15, a falling edge of the first pulse included in the scan output control signal SC_OE may be generated. The scan clock output controlling unit 420 may generate an eighth rising edge RE8 of an eighth pulse PS8 included in the first scan clock signal SC_CLK1 by suspending the controlling of the output of the first scan clock signal SC_CLK1 (e.g., by stopping/removing the blocking of the pulse included in the first scan clock signal SC_CLK1), based on the falling edge of the first pulse included in the scan output control signal SC_OE. Accordingly, the first scan clock signal SC_CLK1 may be increased from the third level VGL to the first level VGH1.

At a sixteenth time t16, a rising edge of the second pulse included in the scan output control signal SC_OE may be generated. The scan clock output controlling unit 420 may generate an eighth falling edge FE8 of the eighth pulse PS8 included in the first scan clock signal SC_CLK1 by controlling the output of the first scan clock signal SC_CLK1, based on the rising edge of the second pulse included in the scan output control signal SC_OE. Accordingly, the first scan clock signal SC_CLK1 may be decreased from the first level VGH1 to the third level VGL.

At a seventeenth time t17, a falling edge of the second pulse included in the scan output control signal SC_OE may be generated. The scan clock output controlling unit 420 may generate a ninth rising edge RE9 of a ninth pulse PS9 included in the first scan clock signal SC_CLK1 by suspending the controlling of the output of the first scan clock signal SC_CLK1, based on the falling edge of the second pulse included in the scan output control signal SC_OE. Accordingly, the first scan clock signal SC_CLK1 may be increased from the third level VGL to the first level VGH1.

At an eighteenth time t18, a rising edge of the first pulse included in the scan-off clock signal SC_OFF_CLK may be generated. At a nineteenth time t19, a falling edge of the first pulse included in the scan-off clock signal SC_OFF_CLK may be generated. From the eighteenth time t18 to the nineteenth time t19, the kickback compensating unit 411 may gradually decrease the ninth pulse PS9 included in the first scan clock signal SC_CLK1 from the first level VGH1 to a second level VGH2, based on the rising edge and the falling edge of the first pulse included in the scan-off clock signal SC_OFF_CLK. For example, during the period from the eighteenth time t18 to the nineteenth time t19, the ninth pulse PS9 may be linearly or exponentially decreased from the first level VGH1 to the second level VGH2. The second level VGH2 may be lower than the first level VGH1 and higher than the third level VGL.

At the nineteenth time t19, the scan clock output unit 410 may generate a ninth falling edge FE9 of the ninth pulse PS9 included in the first scan clock signal SC_CLK1, based on the falling edge of the first pulse included in the scan-off clock signal SC_OFF_CLK. Accordingly, the first scan clock signal SC_CLK1 may be decreased from the second level VGH2 to the third level VGL.

Accordingly, the first scan clock signal SC_CLK1 may include the seventh pulse PS7 of a logic high level from t13 to t14 (i.e., from a time of the falling edge of the first pulse included in the scan-on clock signal SC_ON_CLK to a time of the rising edge of the first pulse included in the scan output control signal SC_OE), the eight pulse PS8 of a logic high level from t15 to t16 (i.e., from a time of the falling edge of the first pulse included in the scan output control signal SC_OE to a time of the rising edge of the second pulse included in the scan output control signal SC_OE), and the ninth pulse PS9 from t17 to t19 (i.e., from a time of the falling edge of the second pulse included in the scan output control signal SC_OE to a time of the falling edge of the first pulse included in the scan-off clock signal SC_OFF_CLK). The ninth pulse PS9 may include a GPM period in which the ninth pulse PS9 is decreased from the first level VGH1 to the second level VGH2 over a period t18 to t19 (i.e., from a time of the rising edge of the first pulse included in the scan-off clock signal SC_OFF_CLK to a time of the falling edge of the first pulse included in the scan-off clock signal SC_OFF_CLK. The ninth pulse PS9 may decrease from the second level VGH2 to the third level VGL at a time of the falling edge of the first pulse included in the scan-off clock signal SC_OFF_CLK.

In addition, at the eighteenth time t18, a rising edge of the second pulse included in the scan-on clock signal SC_ON_CLK may be generated. At a twentieth time t20, a falling edge of the second pulse included in the scan-off clock signal SC_OFF_CLK may be generated. From the eighteenth time t18 to the twentieth time t20, the second clock signal SC_CLK2 may be formed similarly to the first scan clock signal SC_CLK1 from t13 to t19.

In the display period DISPLAY PERIOD shown in FIG. 5, the scan output control signal SC_OE does not include a pulse of a logic high level, and is maintained at a logic low level. Therefore, the scan clock signals SC_CLK1, SC_CLK2, . . . , SC_CLK6 may not have the extra falling edges and rising edges of those in the sensing period SENSING PERIOD.

The sensing clock signals may be formed substantially identically to the scan clock signals described with reference to FIG. 6D, except that each of the sensing clock signals does not include a GPM period at a falling edge.

As described with reference to FIGS. 3 to 5 and 6D, each of the pulses included in each of the scan clock signals SC_CLK1, SC_CLK2, . . . , and SC_CLK6 and the sensing clock signals SS_CLK1, SS_CLK2, . . . , and SS_CLK6 may be changed/divided into three pulses by controlling the times, the lengths, and the period of the pulses included in each of the scan and sensing output control signals SC_OE and SS_OE. In embodiments, each of the pulses included in each of the scan clock signals SC_CLK1, SC_CLK2, . . . , and SC_CLK6 and the sensing clock signals SS_CLK1, SS_CLK2, . . . , and SS_CLK6 may be changed into four or more pulses.

Referring to FIGS. 2 to 5 and 6D, each of the scan signals SCAN1, SCAN2, . . . , and SCANn and the sensing signals SENSE1, SENSE2, . . . , and SENSEn supplied in the sensing period SENSING PERIOD included in the one frame 1 Frame may include three pulses.

When a first pulse among the three pulses included in each of the scan signals SCAN1, SCAN2, . . . , and SCANn and the sensing signals SENSE1, SENSE2, . . . , and SENSEn is applied, the first and second nodes N1 and N2 of the first transistor M1 may be initialized.

When a second pulse among the three pulses included in each of the scan signals SCAN1, SCAN2, . . . , and SCANn and the sensing signals SENSE1, SENSE2, . . . , and SENSEn is applied, the sensing unit 150 may measure threshold voltage information of the driving transistors, and may measure mobility of the driving transistors.

Accordingly, the sensing unit 150 may measure characteristic information of two or more pixels in one sensing period SENSING PERIOD.

As described with reference to FIGS. 3 to 6D, the level shifter 120 including the scan clock generator 121 and the sensing clock generator 122 can change/divide each of the pulses included in each of the scan clock signals SC_CLK1, SC_CLK2, . . . , and SC_CLK6 and the sensing clock signals SS_CLK1, SS_CLK2, . . . , and SS_CLK6 into a plurality of pulses, based on the scan and sensing output control signals SC_OE and SS_OE. Accordingly, in order for the sensing unit 150 (see FIG. 2) to sense a characteristic of the pixels after the initialization operation is performed in the sensing period SENSING PERIOD shown in FIG. 5, the level shifter 120 can generate the scan clock signals SC_CLK1, SC_CLK2, . . . , and SC_CLK6 and the sensing clock signals SS_CLK1, SS_CLK2, . . . , and SS_CLK6, each of which includes pulses changed/divided into a plurality of sub-pulses in the sensing period SENSING PERIOD, using only one scan output control signal SC_OE and one sensing output control signal SS_OE. Thus, a number of signal lines between the timing controller 110 and the level shifter 120, a number of output pins of the timing controller 110, and a number of input pins of the level shifter 120 can be minimized.

Figure 7:
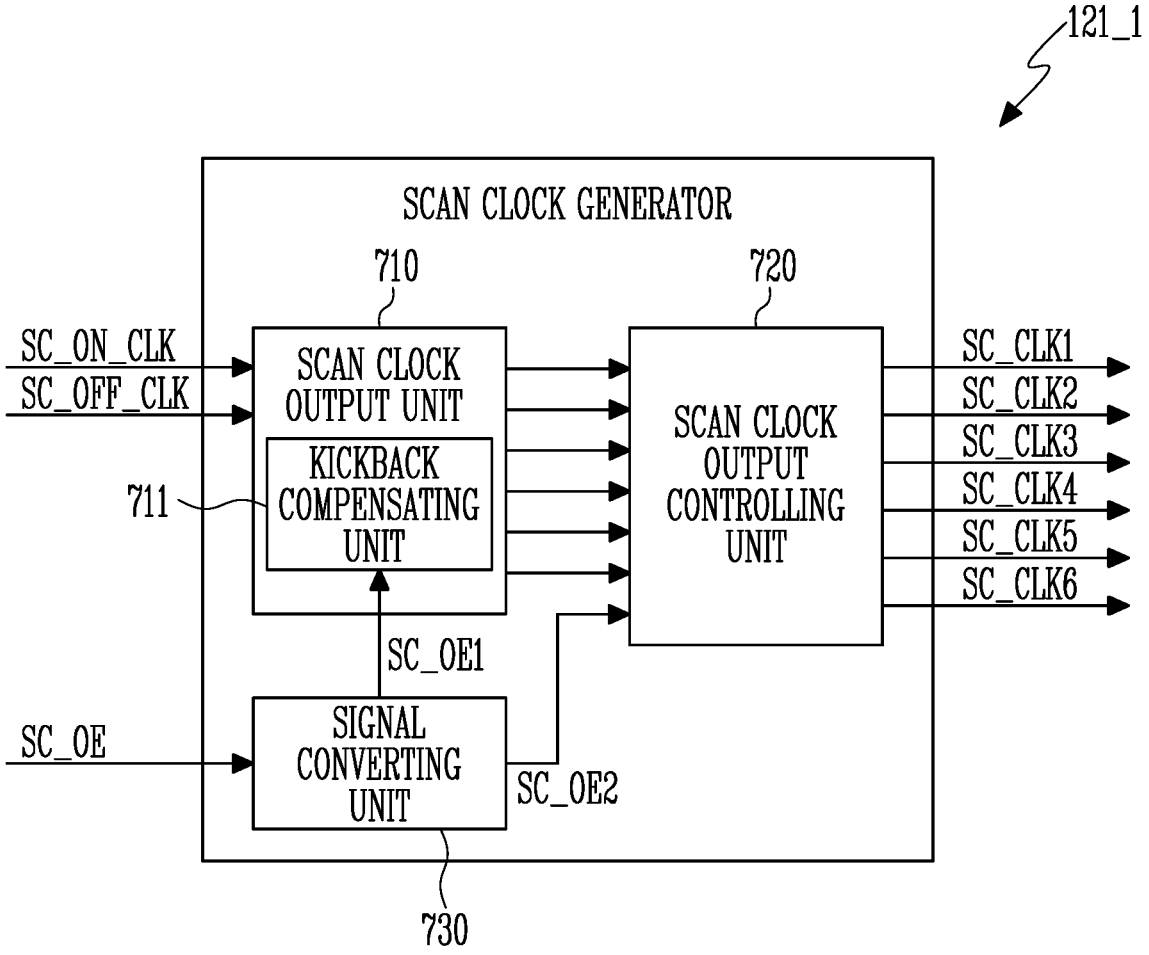
FIG. 7 is a diagram illustrating the scan clock generator included in the level shifter shown in FIG. 3 according to an embodiment.

FIG. 7 is a diagram illustrating scan clock generator included in the level shifter shown in FIG. 3 according to an embodiment.

Referring to FIGS. 4A and 7, the scan clock generator 121_1 shown in FIG. 7 is substantially identical or similar to the scan clock generator 121 shown in FIG. 4A, except a signal converting unit 730.

Referring to FIG. 7, the scan clock generator 121_1 may include a scan clock output unit 710, a scan clock output controlling unit 720, and the signal converting unit 730; the scan clock output unit 710 may include a kickback compensating unit 711.

The kickback compensating unit 711 may control a GPM period to be included at a falling edge of pulses included in each of the scan clock signals SC_CLK1 to SC_CLK6, based on the scan-off clock signal SC_OFF_CLK and a first sub-scan output control signal SC_OE1 (or first scan output control sub-signal SC_OE1).

In a sensing period, the scan clock output controlling unit 720 may change/divide each of the pulses included in each of the scan clock signals SC_CLK1 to SC_CLK6 into a plurality of sub-pulses by partially and temporarily blocking each of the pulses included in each of the scan clock signals SC_CLK1 to SC_CLK6, based on a second sub-scan output control signal SC_OE2 (or second scan output control sub-signal SC_OE2).

The signal converting unit 730 may generate the first sub-scan output control signal SC_OE1 and the second sub-scan output control signal SC_OE2, based on the scan output control signal SC_OE.

Figure 8:
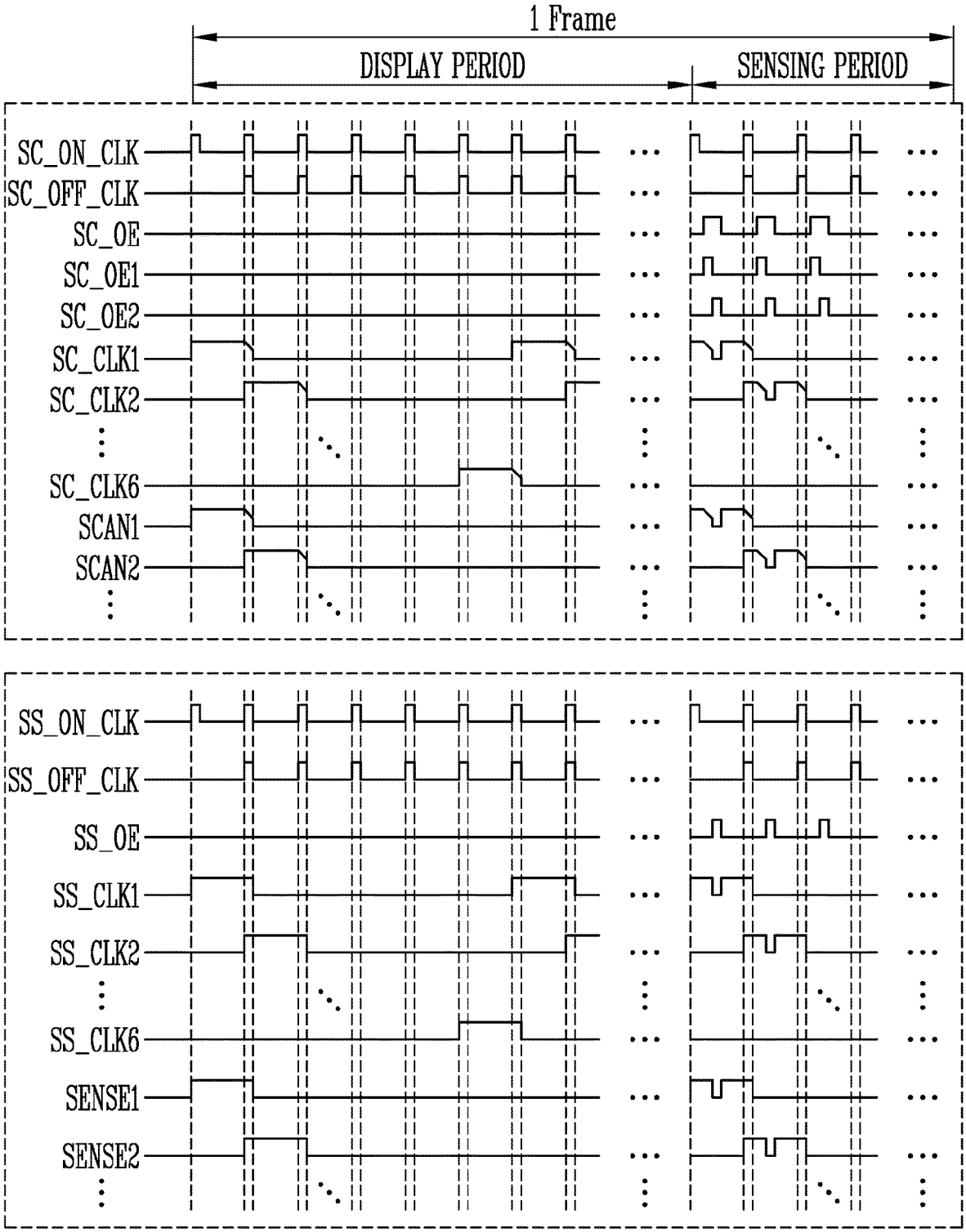
FIG. 8 is a diagram illustrating the gate driver shown in FIG. 3 and signals related to and/or measured in the gate driver according to an embodiment.
Figure 9:
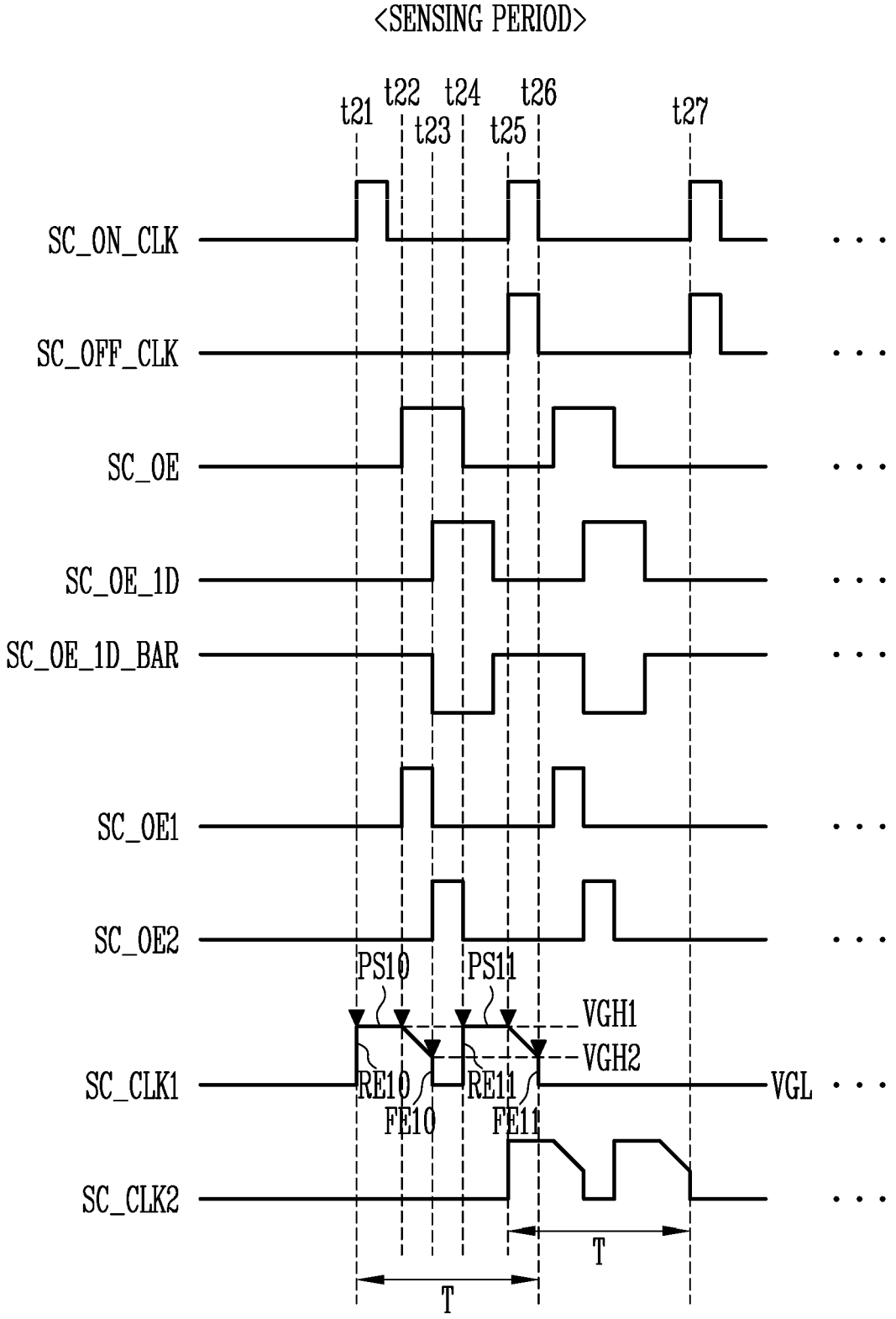
FIG. 9 is a diagram illustrating signals related to and/or measured in the scan clock generator shown in FIG. 7 in a sensing period according to an embodiment.

FIG. 8 is a diagram illustrating gate driver shown in FIG. 3 and the signals related to and/or measured in the gate driver according to an embodiment. FIG. 9 is a diagram illustrating signals related to and/or measured in the scan clock generator shown in FIG. 7 in the sensing period according to an embodiment.

Referring to FIGS. 5 and 8, waveforms of signals shown in FIG. 8 (i.e., scan clock signals SC_CLK1, SC_CLK2, . . . , and SC_CLK6, scan signals SCAN1, SCAN2, . . . , and SCANn, and scan-on and sensing-on clock signals SC_ON_CLK and SS_ON_CLK, scan-off and sensing-off clock signals SC_OFF_CLK and SC_OFF_CLK, a sensing output control signal SS_OE, sensing clock signals SS_CLK1, SS_CLK2, . . . , and SS_CLK6, and sensing signals SENSE1, SENSE2, . . . , and SENSEn in a display period DISPLAY PERIOD and a sensing period SENSING PERIOD), except a scan output control signal SC_OE, first and second sub-scan output control signals SC_OE1 and SC_OE2, the scan clock signals SC_CLK1, SC_CLK2, . . . , and SC_CLK8, and the scan signals SCAN1, SCAN2, . . . , and SCANn in the sensing period SENSING PERIOD shown in FIG. 8, may be substantially identical or similar to those of the signals shown in FIG. 5.

As shown in FIG. 8, in the sensing period SENSING PERIOD, the scan output control signal SC_OE may include a plurality of pulses having a predetermined period. The scan output control signal SC_OE has a period equal to that of each of the scan-on and scan-off clock signals SC_ON_CLK and SC_OFF_CLK. However, the pulses of the scan output control signal SC_OE may not be synchronized with the pulses of either of the scan-on and scan-off clock signals SC_ON_CLK and SC_OFF_CLK, and/or may have phases different from those of the pulses of each of the scan-on and scan-off clock signals SC_ON_CLK and SC_OFF_CLK. A pulse width of the scan output control signal SC_OE may be equal to or unequal to that of the scan-on and scan-off clock signals SC_ON_CLK and SC_OFF_CLK. The pulse width of the scan output control signal SC_OE may be wider than that of the scan-on and scan-off clock signals SC_ON_CLK and SC_OFF_CLK.

Each pulse of the first sub-scan output control signal SC_OE1 may overlap with a first portion of a corresponding one of the pulses of the scan output control signal SC_OE. Each pulse of the second sub-scan output control signal SC_OE2 may overlap with a second portion of the corresponding one of the pulses of the scan output control signal SC_OE different from the first portion overlapped by the corresponding pulse of the first sub-scan output control signal SC_OE1.

In the sensing period SENSING PERIOD shown in FIG. 8, each pulse included in each of the scan clock signals SC_CLK1, SC_CLK2, . . . , and SC_CLK6 may include a GPM period at a falling edge.

In the sensing period SENSING PERIOD, a first scan clock signal SC_CLK1 may include a GPM period having a gradually decreasing signal level and corresponding to a first pulse of the first sub-scan output control signal SC_OE1.

Similarly, a second scan clock signal SC_CLK2 may include a GPM period having a gradually decreasing signal level and corresponding to a second pulse of the first sub-scan output control signal SC_OE1. Like the first and second scan clock signals SC_CLK1 and SC_CLK2, each of third to sixth scan clock signals SC_CLK3 to SC_CLK6 shown in FIG. 8 may also include a GPM period.

The kickback compensating unit 711 may control each of the scan clock signals SC_CLK1, SC_CLK2, . . . , and SC_CLK6 to include a GPM period at a falling edge from a time of a rising edge of the first sub-scan output control signal SC_OE1 to a time of a falling edge of the first sub-scan output control signal SC_OE1.

Referring to FIGS. 7 to 9, the signal converting unit 730 may generate the first sub-scan output control signal SC_OE1 and the second sub-scan output control signal SC_OE2, based on the scan output control signal SC_OE.

Referring to FIG. 9, the signal converting unit 730 may generate a third sub-scan output control signal SC_OE_1D (or third scan output control sub-signal SC_OE_1D) by delaying a copy of the scan output control signal SC_OE by a predetermined time, and may generate a fourth sub-scan output control signal SC_OE_1D_BAR (or fourth scan output control sub-signal SC_OE_1D_BAR) by inverting a copy of the third sub-scan output control signal SC_OE_1D.

The signal converting unit 730 may generate the first sub-scan output control signal SC_OE1 by performing an AND operation on the scan output control signal SC_OE and the fourth sub-scan output control signal SC_OE_1D_BAR. Accordingly, the first sub-scan output control signal SC_OE1 may have a pulse of a logic high level from t22 to t23 when both the scan output control signal SC_OE and the fourth sub-scan output control signal SC_OE_1D_BAR have a logic high level.

The signal converting unit 730 may generate the second sub-scan output control signal SC_OE2 by performing an AND operation on the scan output control signal SC_OE and the third sub-scan output control signal SC_OE_1D. Accordingly, the second sub-scan output control signal SC_OE2 may have a pulse of a logic high level from t23 to t24 when both the scan output control signal SC_OE and the third sub-scan output control signal SC_OE_1D have a logic high level.

The scan output control signal SC_OE may partially overlap with a tenth pulse PS10 of two separated pulses PS10 and PS11 in from t22 to t23, and may not overlap with the eleventh pulse PS11. The first sub-scan output control signal SC_OE1 may overlap with the tenth pulse PS10. The second sub-scan output control signal SC_OE2 may not significantly overlap with either of the tenth and eleventh pulses PS10 and PS11.

Except for a period from a twenty-second time t22 to a twenty-fourth time t24, the first scan clock signal SC_CLK1 shown in FIG. 9 is generated substantially identically or similarly to the first scan clock signal SC_CLK1 described with reference to FIG. 6A.

At the twenty-second time t22, a rising edge of the first pulse included in the first sub-scan output control signal SC_OE1 may be generated. At a twenty-third time t23, a falling edge of the first pulse included in the first sub-scan output control signal SC_OE1 may be generated. From the twenty-second time t22 to the twenty-third time t23, the kickback compensating unit 711 may gradually decrease the tenth pulse PS10 included in the first scan clock signal SC_CLK1 from a first level VGH1 to a second level VGH2, based on the rising edge and the falling edge of the first pulse included in the first sub-scan output control signal SC_OE1. From the twenty-second time t22 to the twenty-third time t23, the tenth pulse PS10 may be linearly or exponentially decreased from the first level VGH1 to the second level VGH2.

At the twenty-third time t23, a rising edge of the first pulse included in the second sub-scan output control signal SC_OE2 may be generated. The scan clock output controlling unit 720 may generate a tenth falling edge FE10 of the tenth pulse PS10 included in the first scan clock signal SC_CLK1 by controlling an output of the first scan clock signal SC_CLK1 (e.g., by partially and temporarily blocking a pulse included in the first scan clock signal SC_CLK1), based on the rising edge of the first pulse included in the second sub-scan output control signal SC_OE2. Accordingly, the first scan clock signal SC_CLK1 may be decreased from the second level VGH2 to a third level VGL.

At the twenty-fourth time t24, a falling edge of the first pulse included in the second sub-scan output control signal SC_OE2 may be generated. The scan clock output controlling unit 720 may generate an eleventh rising edge RE11 of the eleventh pulse PS11 included in the first scan clock signal SC_CLK1 by suspending the controlling of the output of the first scan clock signal SC_CLK (e.g., by stopping/removing the blocking of the pulse included in the first scan clock signal SC_CLK1), based on the falling edge of the first pulse included in the second sub-scan output control signal SC_OE2. Accordingly, the first scan clock signal SC_CLK1 may be increased from the third level VGL to the first level VGH1.

The third sub-scan output control signal SC_OE_1D is generated based on the scan output control signal SC_OE and the delay period from t22 to t23. Accordingly, a length of the GPM period from t22 to t23 included in the tenth pulse PS10 and a length of the blocking period from t23 to t24 (in which the output of the first scan clock signal SC_CLK1 is block) may be controlled.

As described with reference to FIGS. 7 to 9, the scan clock generator 121_1 including the signal converting unit 730 can generate the scan clock signals SC_CLK1, SC_CLK2, . . . , and SC_CLK6, each of which includes pulses each changed/divided into a plurality of sub-pulses, in the sensing period SENSING PERIOD by using only one scan-on clock signal SC_ON_CLK, one scan-off clock signal SC_OFF_CLK, and one scan output control signal SC_OE, and may control a GPM period for compensating for a kickback phenomenon for each of the scan clock signals SC_CLK1, SC_CLK2, . . . , and SC_CLK6. Thus, a number of signal lines between the timing controller 110 and the level shifter 120, a number of output pins of the timing controller 110, and a number of input pins of the level shifter 120 can be minimized.

Figure 10:
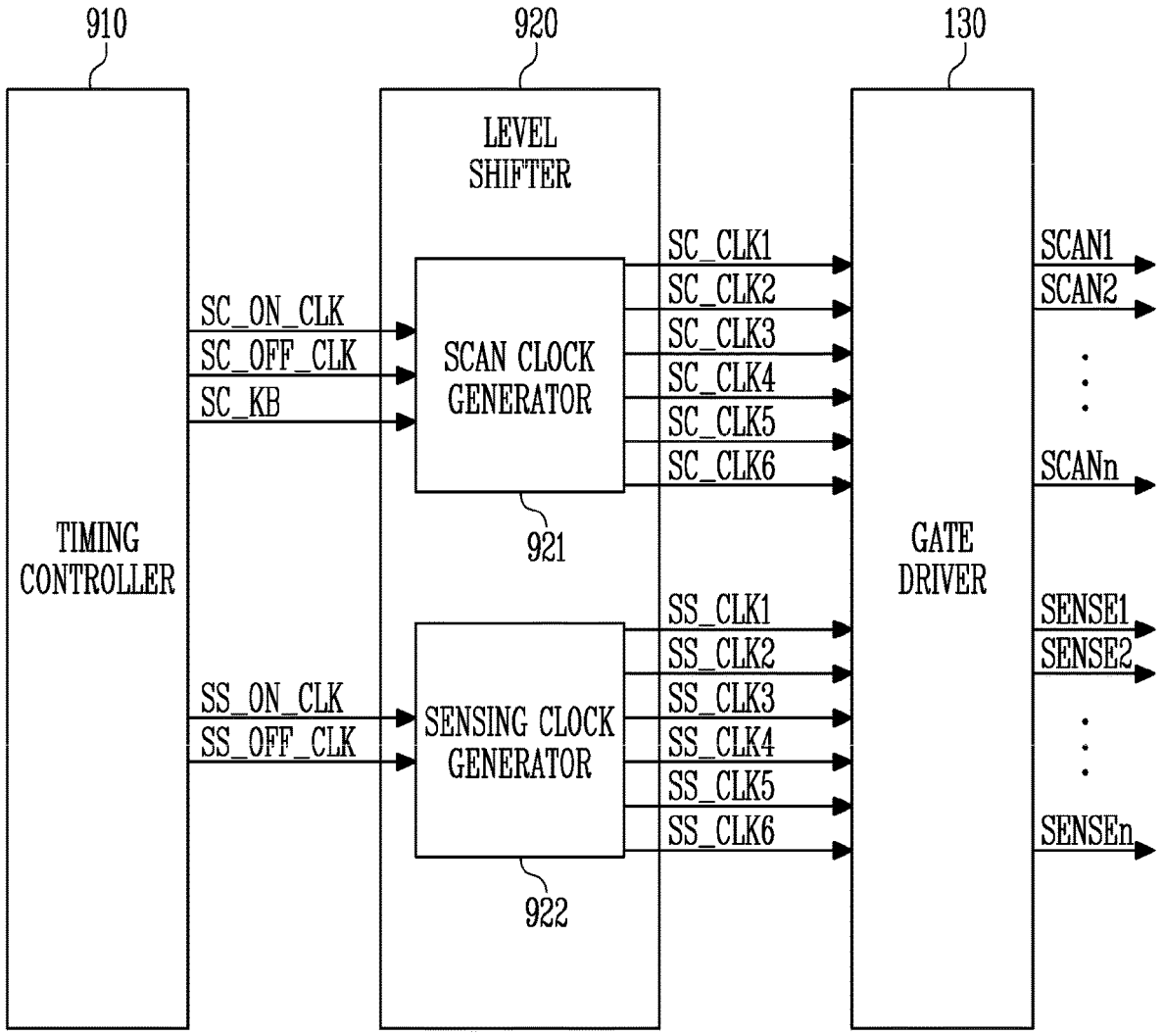
FIG. 10 is a diagram illustrating the timing controller, the level shifter, and the gate driver included in the display device shown in FIG. 1 according to an embodiment.
Figure 11A:
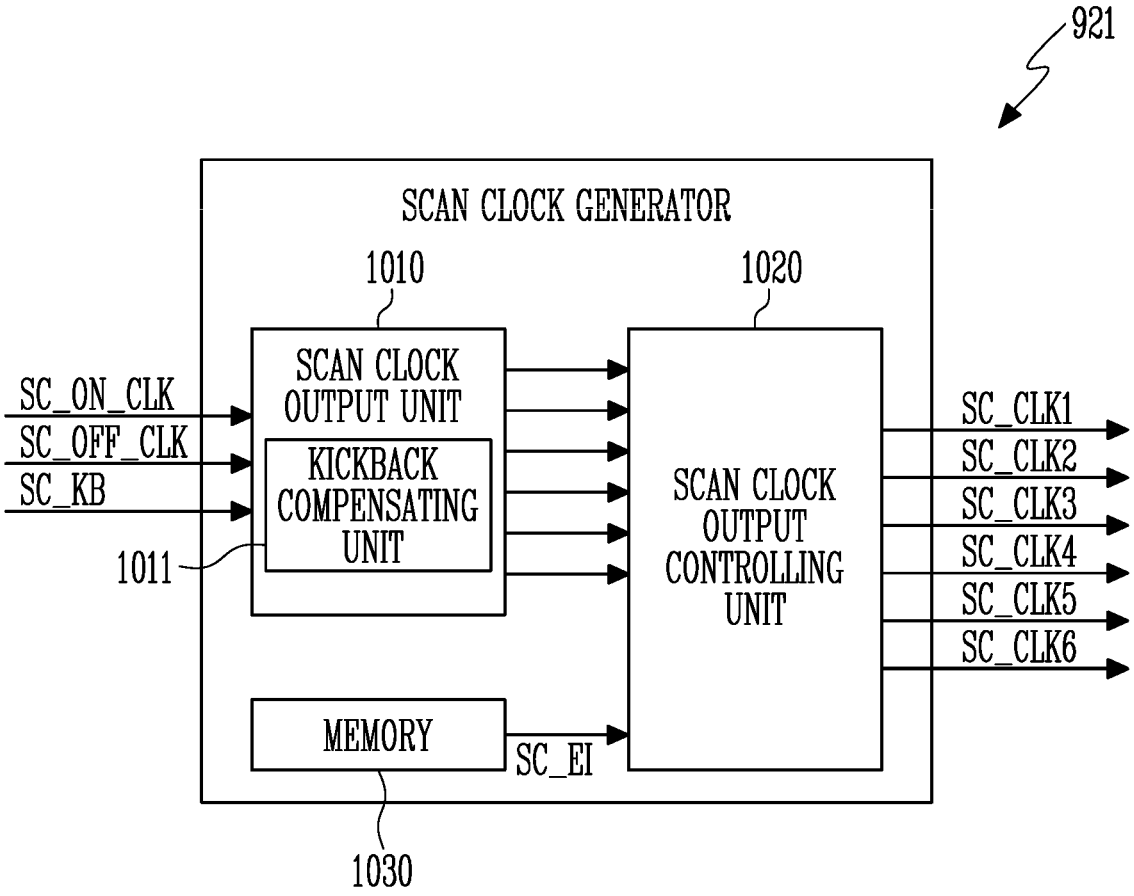
FIG. 11A is a diagram illustrating a scan clock generator included in the level shifter shown in FIG. 10 according to an embodiment.
Figure 11B:
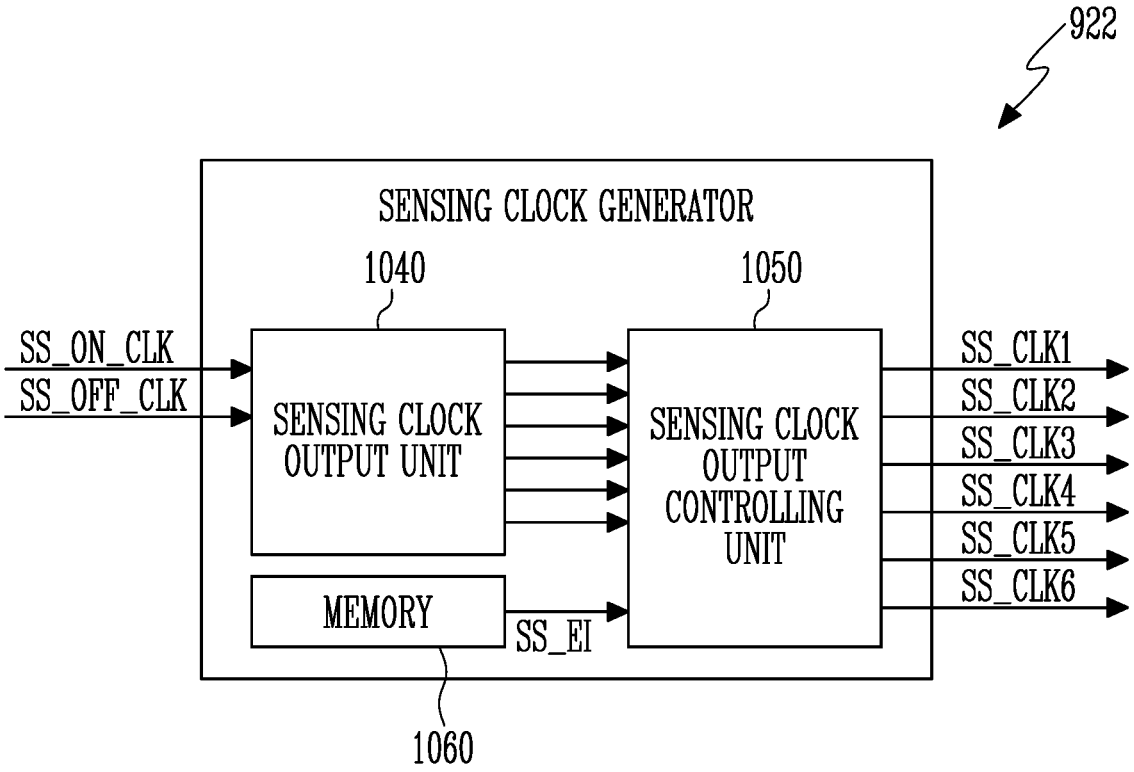
FIG. 11B is a diagram illustrating a sensing clock generator included in the level shifter shown in FIG. 10 according to an embodiment.

FIG. 10 is a diagram illustrating timing controller, the level shifter, and the gate driver included in the display device shown in FIG. 1 according to an embodiment. FIG. 11A is a diagram illustrating a scan clock generator included in the level shifter shown in FIG. 10 according to an embodiment. FIG. 11B is a diagram illustrating a sensing clock generator included in the level shifter shown in FIG. 10 according to an embodiment.

Referring to FIGS. 3 and 10, the timing controller 910 shown in FIG. 10 may be substantially identical or similar to the timing controller 110 described with reference to FIG. 3, except that the timing controller 910 generates a scan kickback compensation signal SC_KB instead of the scan output control signal SC_OE and the sensing output control signal SS_OE shown in FIG. 3.

Referring to FIG. 10, the level shifter 920 may include a scan clock generator 921 and a sensing clock generator 922.

Referring to FIGS. 10 and 11A, the scan clock generator 921 may generate scan clock signals SC_CLK1, SC_CLK2, . . . , and SC_CLK6 based on a scan-on clock signal SC_ON_CLK, a scan-off clock signal SC_OFF_CLK, the scan kickback compensation signal SC_KB, and a predetermined scan edge time information SC_EI. The scan clock generator 921 may shift a voltage level of each of the scan clock signals SC_CLK1, SC_CLK2, . . . , and SC_CLK6 to an operable voltage level of the transistors included in the pixels and then provide the shifted voltage level to the gate driver 130.

The scan clock generator 921 may include a scan clock output unit 1010, a scan clock output controlling unit 1020, and a memory 1030; the scan clock output unit 1010 may include a kickback compensating unit 1011. The scan clock output unit 1010 and the scan clock output controlling unit 1020 are similar to the scan clock output unit 410 and the scan clock output controlling unit 420 described with reference to FIG. 4A.

The kickback compensating unit 1011 may control each of the scan clock signals SC_CLK1, SC_CLK2, . . . , and SC_CLK6 to include a GPM period at a falling edge of a pulse based on the scan-off clock signal SC_OFF_CLK and the scan kickback compensation signal SC_KB.

The memory 1030 may store scan edge time information SC_EI on rising and falling edges of each of the scan clock signals SC_CLK1, SC_CLK2, . . . , and SC_CLK6. The scan edge time information SC_EI may be predetermined before or in a manufacturing process of the display device. Information on a period for controlling an output of each of the scan clock signals SC_CLK1, SC_CLK2, . . . , and SC_CLK6 may be included in the scan edge time information SC_EI. The scan edge time information SC_EI may include information on a blocking period in which a pulse included in each of the scan clock signals SC_CLK1, SC_CLK2, . . . , and SC_CLK6 is blocked (or dipped).

The scan clock output controlling unit 1020 may change/divide each of pulses included in each of the scan clock signals SC_CLK1, SC_CLK2, . . . , and SC_CLK6 into a plurality of sub-pulses by partially and temporarily blocking/dipping each pulse included in each of the scan clock signals SC_CLK1, SC_CLK2, . . . , and SC_CLK6 based on the scan edge time information SC_EI.

Referring to FIGS. 10 and 11B, the sensing clock generator 922 may generate sensing clock signals SS_CLK1, SS_CLK2, . . . , and SS_CLK6 based on the sensing-on clock signal SS_ON_CLK, the sensing-off clock signal SS_OFF_CLK, and the predetermined sensing edge time information SS_EI. The sensing clock generator 922 may shift a voltage level of each of the sensing clock signals SS_CLK1, SS_CLK2, . . . , and SS_CLK6 to an operable voltage level of the transistors included in the pixels and then provide the shifted voltage level to the gate driver 130.

The sensing clock generator 922 may include a sensing clock output unit 1040, a sensing clock output controlling unit 1050, and a memory 1060. The sensing clock output unit 1040 and the sensing clock output controlling unit 1050 are similar to the sensing clock output unit 430 and the sensing clock output controlling unit 440 described with reference to FIG. 4A.

The memory 1060 may store sensing edge time information SS_EI on each of rising and falling edges of each of the sensing clock signals SS_CLK1, SS_CLK2, . . . , and SS_CLK6. Information on a period for controlling an output of each of the sensing clock signals SS_CLK1, SS_CLK2, . . . , and SS_CLK6 may be included in the sensing edge time information SS_EI. The sensing edge time information SS_EI may include information on a blocking period in which a pulse included in each of the sensing clock signals SS_CLK1, SS_CLK2, . . . , and SS_CLK6 is blocked (or dipped).

In a sensing period, the sensing clock output controlling unit 1050 may change/divide each of pulses included in each of the sensing clock signals SS_CLK1, SS_CLK2, . . . , and SS_CLK6 into a plurality of sub-pulses by partially and temporarily blocking/dipping each pulse included in each of the sensing clock signals SS_CLK1, SS_CLK2, . . . , and SS_CLK6 based on the sensing edge time information SS_EI.

The memory 1030 included in the scan clock generator 921 shown in FIG. 11A and the memory 1060 included in the sensing clock generator 922 shown in FIG. 11B may be implemented in a single memory included in the level shifter 920.

Figure 12:
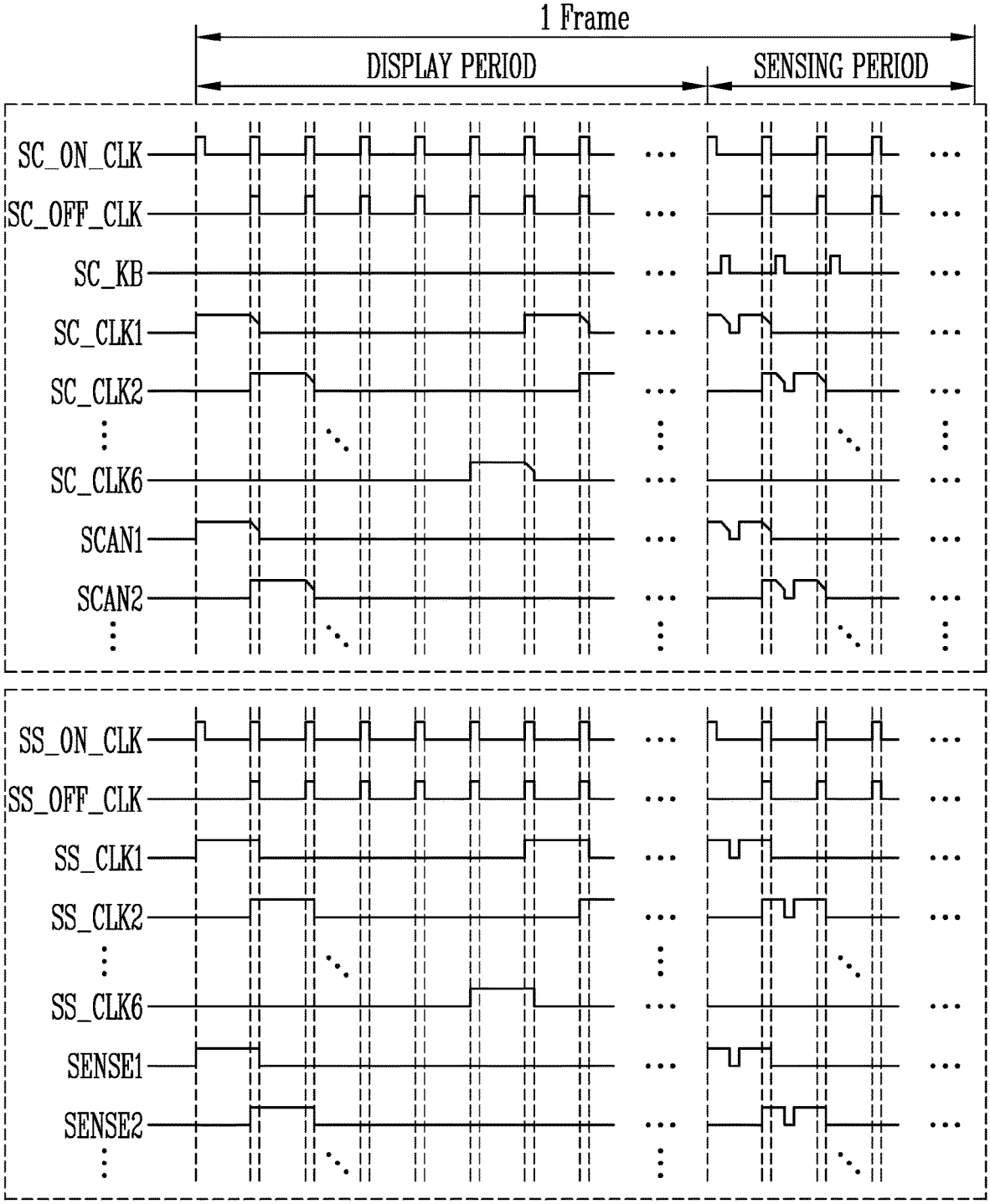
FIG. 12 is a diagram illustrating signals related to and/or measured in the level shifter and the gate driver shown in FIG. 10 according to an embodiment.

FIG. 12 is a diagram illustrating signals related to and/or measured in the level shifter and the gate driver shown in FIG. 10 according to an embodiment.

Referring to FIGS. 3, 5, 10, and 12, waveforms of signals shown in FIG. 12 (i.e., scan clock signals SC_CLK1, SC_CLK2, . . . , and SC_CLK6, scan signals SCAN1, SCAN2, . . . , and SCANn, and scan-on and sensing-on clock signals SC_ON_CLK and SS_ON_CLK, scan-off and sensing-off clock signals SC_OFF_CLK and SS_OFF_CLK, sensing clock signals SS_CLK1, SS_CLK2, . . . , and SS_CLK6, and sensing signals SENSE1, SENSE2, . . . , and SENSEn in a display period DISPLAY PERIOD and a sensing period SENSING PERIOD) may be substantially identical or similar, respectively, to those of the signals shown in FIG. 5, except a scan kickback compensation signal SC_KB, the scan clock signals SC_CLK1, SC_CLK2, . . . , and SC_CLK6, and the scan signals SCAN1, SCAN2, . . . , and SCANn in the sensing period SENSING PERIOD.

Referring to FIG. 12, in the sensing period SENSING PERIOD, the scan kickback compensation signal SC_KB has the same period as each of the scan-on and sensing-on clock signals SC_ON_CLK and SS_ON_CLK, but may include pulses not synchronized with pulses of either of the scan-on and sensing-on clock signals SC_ON_CLK and SS_ON_CLK.

In the sensing period SENSING PERIOD shown in FIG. 12, each pulse included in each of the scan clock signals SC_CLK1, SC_CLK2, . . . , and SC_CLK6 may include a GPM period at a falling edge.

In the sensing period SENSING PERIOD, a first scan clock signal SC_CLK1 may include a GPM period corresponding to a gradually decreasing signal level of the first scan clock signal SC_CLK1 and corresponding to a first pulse of the scan kickback compensation signal SC_KB. Similarly, a second scan clock signal SC_CLK2 may include a GPM period corresponding to a gradually decreasing signal level of the second scan clock signal SC_CLK2 and corresponding to a second pulse of the scan kickback compensation signal SC_KB. Like the first and second scan clock signals SC_CLK1 and SC_CLK2, each of third to sixth scan clock signals SC_CLK3 to SC_CLK6 shown in FIG. 12 may also have a GPM period.

The kickback compensating unit 1011 may control each of the scan clock signals SC_CLK1, SC_CLK2, . . . , and SC_CLK6 to include a GPM period at a falling edge of each pulse included in each of the scan clock signals SC_CLK1, SC_CLK2, . . . , and SC_CLK6 a time of a rising edge of the scan kickback compensation signal SC_KB to a time of a falling edge of the scan kickback compensation signal SC_KB.

In the display period DISPLAY PERIOD and the sensing period SENSING PERIOD, as described with reference to FIGS. 3, 4A, and 5, the gate driver 130 may generate scan signals SCAN1, SCAN2, . . . , and SCANn, corresponding to the scan clock signals SC_CLK1, SC_CLK2, . . . , and SC_CLK6 provided from the scan clock generator 921.

Figure 13A:
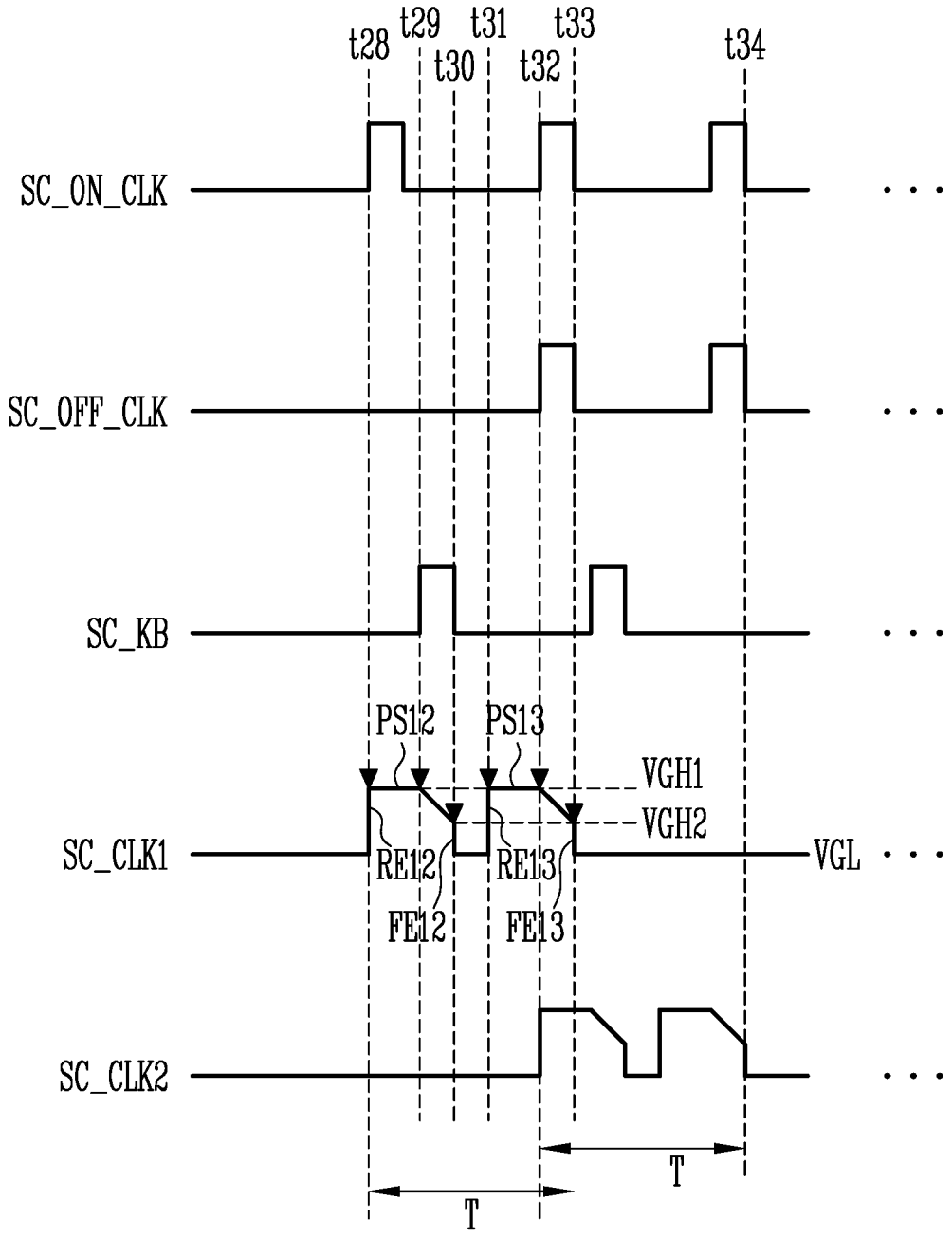
FIG. 13A is a diagram illustrating signals related to and/or measured in the scan clock generator shown in FIG. 11A in a sensing period according to an embodiment.

FIG. 13A is a diagram illustrating signals related to and/or measured in the scan clock generator shown in FIG. 11A in the sensing period according to an embodiment.

Referring to FIGS. 10, 11A, 12, and 13A, the scan edge time information SC_EI stored in the memory 1030 shown in FIG. 11A may include first information on a time of a twelfth falling edge FE12 of a twelfth pulse PS12 and may include second information on a time of a thirteenth rising edge RE13 of a thirteenth pulse PS13. The scan edge time information SC_EI may include information on rising and falling edges of each of the pulses included in the second to sixth scan clock signals SC_CLK2 to SC_CLK6.

Except for a period from a twenty-ninth time t29 to a thirty-first time t31, the first scan clock signal SC_CLK1 shown in FIG. 13A is generated substantially identically or similarly to the first scan clock signal SC_CLK1 described with reference to FIG. 6A.

At the twenty-ninth time t29, a rising edge of the first pulse included in the scan kickback compensation signal SC_KB may be generated. At a thirtieth time t30, a falling edge of the first pulse included in the scan kickback compensation signal SC_KB may be generated. From the twenty-ninth time t29 to the thirtieth time t30, the kickback compensating unit 1011 may gradually decrease the twelfth pulse PS12 included in the first scan clock signal SC_CLK1 from a first level VGH1 to a second level VGH2 based on the rising edge and the falling edge of the first pulse included in the scan kickback compensation signal SC_KB. From the twenty-ninth time t29 to the thirtieth time t30, the twelfth pulse PS12 may be linearly or exponentially decreased from the first level VGH1 to the second level VGH2.

At the thirtieth time t30, the scan clock output controlling unit 1020 may generate the twelfth falling edge FE12 of the twelfth pulse PS12 included in the first scan clock signal SC_CLK1 by controlling an output of the first scan clock signal SC_CLK1 based on the first information. Accordingly, the first scan clock signal SC_CLK1 may decrease from the second level VGH2 to a third level VGL.

At the thirty-first time t31, the scan clock output controlling unit 1020 may generate the thirteenth rising edge RE13 of the thirteenth pulse PS13 included in the first scan clock signal SC_CLK1 by suspending the controlling of the output of the first scan clock signal SC_CLK1 based on the second information. Accordingly, the first scan clock signal SC_CLK1 may increase from the third level VGL to the first level VGH1.

Figure 13B:
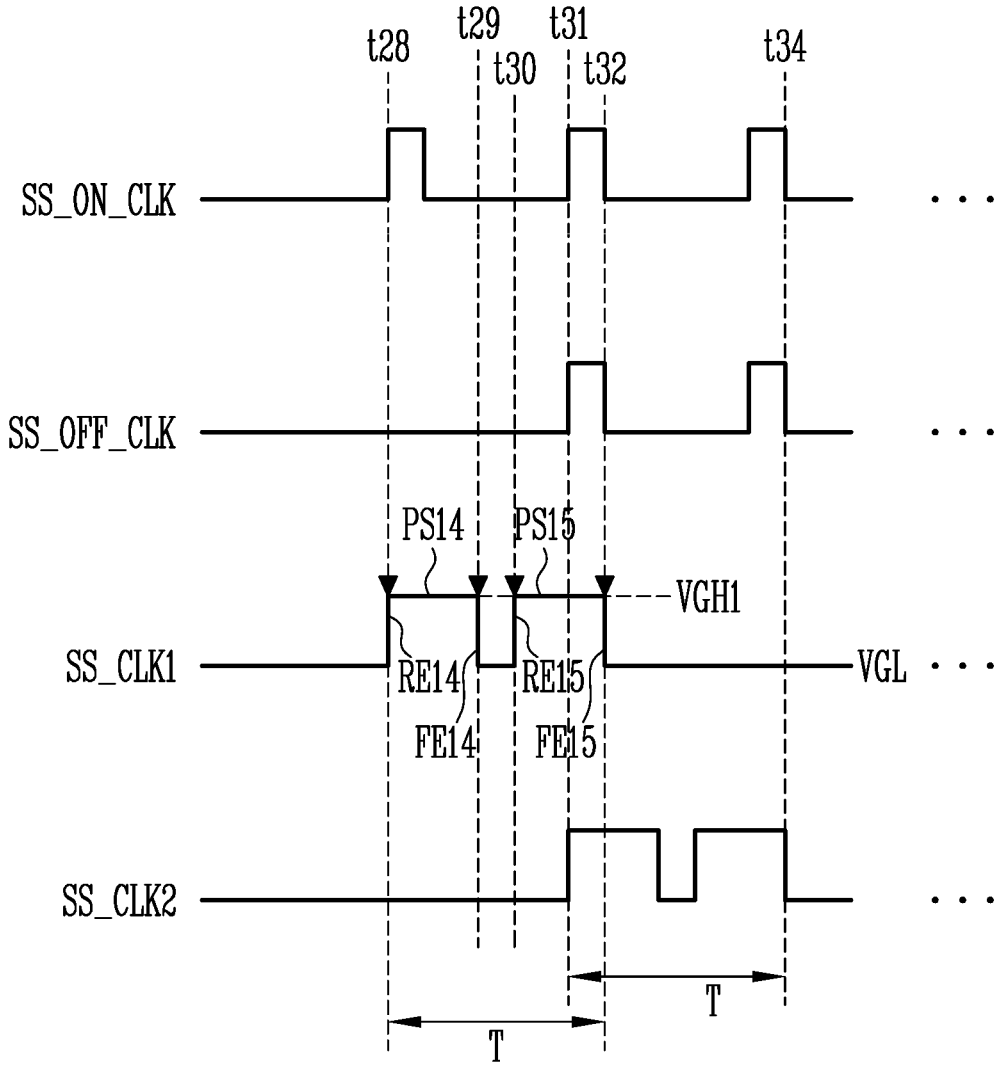
FIG. 13B is a diagram illustrating signals related to and/or measured in the sensing clock generator shown in FIG. 11B in the sensing period according to an embodiment.

FIG. 13B is a diagram illustrating signals related to and/or measured in the sensing clock generator shown in FIG. 11A in the sensing period according to an embodiment.

Referring to FIGS. 10, 11B, 12, and 13B, the sensing edge time information SS_EI stored in the memory 1060 shown in FIG. 11B may include third information on a time of a fourteenth falling edge FE14 of a fourteenth pulse PS14 and may include fourth information on a time of a fifteenth rising edge RE15 of a fifteenth pulse PS15. The sensing edge time information SS_EI may include information on rising and falling edges of each pulse included in each of the second to sixth sensing clock signals SS_CLK2 to SS_CLK6.

Referring to FIGS. 10 to 13B, the sensing clock generator 922 shown in FIG. 11B may not include the kickback compensating unit 1011 described with reference to FIG. 11A. Accordingly, each of the sensing clock signals SS_CLK1, SS_CLK2, . . . , and SS_CLK6 shown in FIGS. 12 and 13B may not include a GPM period at a falling edge. Except the GPM period, the sensing clock signals SS_CLK1, SS_CLK2, . . . , and SS_CLK6 are substantially identical or similar, respectively, to the scan clock signals SC_CLK1, SC_CLK2, . . . , and SC_CLK6 described with reference to FIGS. 10, 11A, 12, and 13A.

As described with reference to FIGS. 10 to 13B, the level shifter 920 may change/divide each of pulses included in each of the scan clock signals SC_CLK1, SC_CLK2, . . . , and SC_CLK6 and the sensing clock signals SS_CLK1, SS_CLK2, . . . , and SS_CLK6 into a plurality of sub-pulses based on the scan and sensing edge time information SC_EI and SS_EI. Accordingly, in order for the sensing unit 150 (see FIG. 2) to sense a characteristic of the pixels after an initialization operation is performed in the sensing period SENSING PERIOD shown in FIG. 12, the level shifter 920 may generate the scan clock signals SC_CLK1, SC_CLK2, . . . , and SC_CLK6 and the sensing clock signals SS_CLK1, SS_CLK2, . . . , and SS_CLK6, each of which includes pulses each changed/divided into a plurality of sub-pulses in the sensing period SENSING PERIOD, through the scan and sensing edge time information SC_EI and SS_EI stored in the memories 1030 and 1060 (respectively included in the scan and sensing clock generators 921 and 922). Thus, a number of signal lines between the timing controller 110 and the level shifter 120, a number of output pins of the timing controller 110, and a number of input pins of the level shifter 120 can be minimized.

In accordance with embodiments, a display device generates a plurality of gate clock signals using only one on-clock signal, one off-clock signal, and one output control signal, so that a number of signal lines between the timing controller and the level shifter, a number of output pins of the timing controller, and a number of input pins of the level shifter can be minimized.

In embodiments, a display device can generate gate clock signals for compensating for a kickback phenomenon, without adding additional signal lines between the timing controller and the level shifter, additional output pins of the timing controller, or additional input pins of the level shifter.

Example embodiments have been disclosed. The example embodiments are for illustration and not for limitation. Features, characteristics, and/or elements described in connection with a particular embodiment may be used singly or in combination with features, characteristics, and/or elements described in connection with other embodiments unless otherwise specifically indicated. Various changes may be made to the example embodiments without departing from the scope as set forth in the following claims.

What is claimed is:

1. A display device comprising:

a timing controller configured to generate a first on-clock signal, a first off-clock signal, and a first output control signal;

a level shifter electrically connected to the timing controller and configured to generate a first first-type gate clock signal and a second first-type gate clock signal, wherein a rising edge of the first first-type gate clock signal and a falling edge of the first first-type gate clock signal are respectively synchronized with a rising edge of a pulse of the first on-clock signal and a falling edge of a pulse of the first off-clock signal;

a gate driver electrically connected to the level shifter and configured to output first-type gate signals based on the first first-type gate clock signal; and a display panel electrically connected to the gate driver and including pixels, wherein the pixels are configured to emit lights in response to the first-type gate signals, wherein the first output control signal includes a first pulse and a second pulse, wherein the first pulse of the first output control signal occurs between the pulse of the first on-clock signal and the pulse of the first off-clock signal, wherein the pulse of the first off-clock signal occurs between the first pulse of the first output control signal and the second pulse of the first output control signal, wherein the level shifter is configured to partially block a pulse of the first first-type gate clock signal at the first pulse of the first output control signal to generate first two first-type sub-pulses, wherein the level shifter is configured to partially block a pulse of the second first-type gate clock signal according to the second pulse of the first output control signal or the pulse of the first off-clock signal to generate second two first-type sub-pulses, and wherein one of the first two first-type sub-pulses overlaps with one of the second two first-type sub-pulses.

2. The display device of claim 1, wherein the first two first-type sub-pulses include a first first-type sub-pulse and a second first-type sub-pulse, wherein the first first-type sub-pulse includes a first rising edge and a first falling edge, and wherein the second first-type sub-pulse includes a second rising edge and a second falling edge.

3. The display device of claim 2, wherein a pulse of the first output control signal occurs after the first rising edge and before the second falling edge.

4. The display device of claim 3, wherein the level shifter includes:

a first gate clock output unit configured to generate the first rising edge and the second falling edge, wherein the first rising edge is synchronized with a rising edge of a pulse of the first on-clock signal, and wherein the second falling edge is synchronized with a falling edge of a pulse of the first off-clock signal; and a first gate clock output controlling unit configured to generate the first falling edge and the second rising edge, wherein the first falling edge is synchronized with a rising edge of the pulse of the first output control signal, and wherein the second rising edge is synchronized with a falling edge of the pulse of the first output control signal.

5. The display device of claim 4, wherein the first gate clock output unit:

gradually decreases the second first-type sub-pulse from a first level to a second level lower than the first level during a period from a time of a rising edge of the pulse of the first off-clock signal to a time of the falling edge of the pulse of the first off-clock signal is generated, and decreases the second first-type sub-pulse from the second level to a third level lower than the second level at the time of the falling edge of the pulse of the first off-clock signal.

6. The display device of claim 2, wherein a pulse of the first output control signal overlaps a portion of the first first-type sub-pulse and does not overlap the second first-type sub-pulse.

7. The display device of claim 6, wherein the level shifter includes a signal converting unit, and wherein the signal converting unit generates:

a first output control sub-signal by delaying a first copy of the first output control signal by a predetermined time, a second output control sub-signal by inverting a second copy of the first output control sub-signal, a third output control sub-signal by performing an AND operation on the first output control signal and the second output control sub-signal, and a fourth output control sub-signal by performing an AND operation on the first output control signal and the first output control sub-signal.

8. The display device of claim 7, wherein the level shifter further includes:

a first gate clock output unit configured to generate the first rising edge and the second falling edge, wherein the first rising edge is synchronized with a rising edge of a pulse of the first on-clock signal, and wherein the second falling edge is synchronized with a falling edge of a pulse of the first off-clock signal; and a first gate clock output controlling unit configured to generate the first falling edge and the second rising edge, wherein the first falling edge is synchronized with a rising edge of a pulse of the fourth output control sub-signal, and wherein the second rising edge is synchronized with a falling edge of the pulse of the fourth output control sub-signal.

9. The display device of claim 8, wherein the first gate clock output unit:

gradually decreases the second first-type sub-pulse from a first level to a second level lower than the first level during a period from a time of a rising edge of the pulse of the first off-clock signal to a time of the falling edge of the pulse of the first off-clock signal, and decreases the second first-type sub-pulse from the second level to a third level lower than the second level at the time of the falling edge of the pulse of the first off-clock signal.

10. The display device of claim 9, wherein the first gate clock output unit:

gradually decreases the first first-type sub-pulse from the first level to the second level during a period from a time of a rising edge of a pulse of the third output control sub-signal to a time of a falling edge of the pulse of the third output control sub-signal, and decreases the first first-type sub-pulse from the second level to the third level at the time of the falling edge of the pulse of the third output control sub-signal.

11. The display device of claim 1, wherein pulses of the first on-clock signal are provided according to a predetermined period, and wherein pulses of the first off-clock signal are provided according to the predetermined period and are synchronized with the pulses of the first on-clock signal.

12. The display device of claim 1, wherein pulses of the first on-clock signal are provided according to a predetermined period, wherein pulses of the first off-clock signal are provided according to the predetermined period, and wherein each pulse of the pulses formed of the first off-clock signal is provided between two successive pulses of the pulses of the first on-clock signal.

13. The display device of claim 1, further comprising a sensing unit configured to sense the pixels in response to second-type gate signals, wherein the timing controller is configured to generate a second on-clock signal, a second off-clock signal, and a second output control signal, wherein the level shifter:

generates a first second-type gate clock signal, wherein a rising edge of the first second-type gate clock signal and a falling edge of the first second-type gate clock signal are respectively synchronized with a rising edge of the second on-clock signal and a falling edge of the second off-clock signal; and partially blocks a pulse of the first second-type gate clock signal based on the second output control signal to generate second-type sub-pulses, wherein the gate driver outputs the second-type gate signals based on the first second-type gate clock signal.

14. The display device of claim 1, wherein the first two first-type sub-pulses are separated from each other by exactly a width of the first pulse of the first output control signal.

15. A display device comprising:

a timing controller configured to generate a first on-clock signal and a first off-clock signal;

a level shifter electrically connected to the timing controller and configured to generate a first first-type gate clock signal, wherein a rising edge of the first first-type gate clock signal and a falling edge of the first first-type gate clock signal are respectively synchronized with a rising edge of the first on-clock signal and a falling edge of the first off-clock signal;

a gate driver electrically connected to the level shifter and configured to output first-type gate signals based on the first first-type gate clock signal; and a display panel electrically connected to the gate driver and including pixels, wherein the pixels are configured to emit lights in response to the first-type gate signals, wherein the level shifter is configured to partially block a pulse of the first first-type gate clock signal based on predetermined edge time information to generate first-type sub-pulses, wherein the first-type sub-pulses include a first first-type sub-pulse and a second first-type sub-pulse, wherein the first first-type sub-pulse includes a first rising edge and a first falling edge, wherein the second first-type sub-pulse includes a second rising edge and a second falling edge, and wherein the first falling edge of the first first-type sub-pulse and the second rising edge of the second first-type sub-pulse both occur after the rising edge of the first on-clock signal and both occur before the falling edge of the first off-clock signal.

16. The display device of claim 15, wherein the predetermined edge time information includes first information on a time of the first falling edge and includes second information on a time of the second rising edge, wherein the level shifter includes:

a memory configured to store the first information and the second information;

a first gate clock output unit configured to generate the first rising edge and the second falling edge, wherein the first rising edge is synchronized with a rising edge of a pulse of the first on-clock signal, and wherein the second falling edge is synchronized with a falling edge of a pulse of the first off-clock signal; and a first gate clock output controlling unit configured to generate the first falling edge and the second rising edge based on the first information and the second information, respectively.

17. The display device of claim 16, wherein the first gate clock output unit:

gradually decreases the second first-type sub-pulse from a first level to a second level lower than the first level during a period from a time of a rising edge of the pulse of the first off-clock signal to a time of the falling edge of the pulse of the first off-clock signal is generated, and decreases the second first-type sub-pulse from the second level to a third level lower than the second level at the time of the falling edge of the pulse of the first off-clock signal.

18. The display device of claim 17, wherein the timing controller further generates a kickback compensation signal, wherein the first gate clock output unit:

gradually decreases the first first-type sub-pulse from the first level to the second level during a period from a time of a rising edge of a pulse of the kickback compensation signal to a time of a falling edge of the pulse of the kickback compensation signal, and decreases the first first-type sub-pulse from the second level to the third level at the time of the falling edge of the pulse of the kickback compensation signal.

19. A display device comprising:

a timing controller configured to generate a first on-clock signal, a first off-clock signal, and a first output control signal;

a level shifter electrically connected to the timing controller and configured to generate a first first-type gate clock signal, wherein a rising edge of the first first-type gate clock signal and a falling edge of the first first-type gate clock signal are respectively synchronized with a rising edge of the first on-clock signal and a falling edge of the first off-clock signal;

a gate driver electrically connected to the level shifter and configured to output first-type gate signals based on the first first-type gate clock signal; and a display panel electrically connected to the gate driver and including pixels, wherein the pixels are configured to emit lights in response to the first-type gate signals, wherein the level shifter is configured to partially block a pulse of the first first-type gate clock signal based on the first output control signal to generate first-type sub-pulses, wherein the level shifter includes a signal converting unit, and wherein the signal converting unit generates:

a first output control sub-signal by delaying a first copy of the first output control signal by a predetermined time, a second output control sub-signal by inverting a second copy of the first sub-output control signal, a third output control sub-signal by performing an AND operation on the first output control signal and the second output control sub-signal, and a fourth output control sub-signal by performing an AND operation on the first output control signal and the first output control sub-signal.

* * * * *